US010707581B2

(12) United States Patent
Mohtashami et al.

(10) Patent No.: US 10,707,581 B2
(45) Date of Patent: Jul. 7, 2020

(54) DIPOLE ANTENNA FOR MICROWAVE ABLATION

(71) Applicant: Wisconsin Alumni Research Foundation, Madison, WI (US)

(72) Inventors: Yahya Mohtashami, Madison, WI (US); Nader Behdad, Oregon, WI (US); Susan C. Hagness, Madison, WI (US)

(73) Assignee: WISCONSIN ALUMNI RESEARCH FOUNDATION, Madison, WI (US)

( * ) Notice: Subject to any disclaimer, the term of this patent is extended or adjusted under 35 U.S.C. 154(b) by 173 days.

(21) Appl. No.: 15/860,943

(22) Filed: Jan. 3, 2018

(65) Prior Publication Data

US 2019/0207316 A1 Jul. 4, 2019

(51) Int. Cl.

| | |
|---|---|
| ***H01Q 9/14*** | (2006.01) |
| ***H01Q 9/20*** | (2006.01) |
| ***H01Q 9/18*** | (2006.01) |
| ***H01Q 11/08*** | (2006.01) |
| *H01Q 1/52* | (2006.01) |

(52) U.S. Cl.

CPC ..... *H01Q 9/20* (2013.01); *H01Q 9/14* (2013.01); *H01Q 9/18* (2013.01); *H01Q 11/08* (2013.01); *H01Q 1/526* (2013.01)

(58) Field of Classification Search

CPC ..... H01Q 9/20; H01Q 9/14; H01Q 1/526

See application file for complete search history.

(56) References Cited

U.S. PATENT DOCUMENTS

| | | | |
|---|---|---|---|
| 3,013,226 | A | 12/1961 | Hamel et al. |
| 4,825,880 | A | 5/1989 | Stauffer et al. |
| 5,246,438 | A | 9/1993 | Langberg |
| 5,300,099 | A | 4/1994 | Rudie |
| 5,531,662 | A | 7/1996 | Carr |
| 5,683,382 | A | 11/1997 | Lenihan |

(Continued)

FOREIGN PATENT DOCUMENTS

| | | |
|---|---|---|
| JP | 2004-311334 | 11/2004 |
| JP | 2008-142467 | 6/2008 |

OTHER PUBLICATIONS

Luyen et al., A Minimally Invasive, Coax-Fed Microwave Ablation Antenna with a Tapered-Slot Balun, IEEE International Symposium on Antennas and Propagation/USNC-URSI National Radio Science meeting, Jun. 26, 2016, Puerto Rico.

(Continued)

*Primary Examiner* — Graham P Smith

(74) *Attorney, Agent, or Firm* — Bell & Manning, LLC

(57) ABSTRACT

An antenna includes a first dipole arm and a second dipole arm. The first dipole arm is connected to a first conductor and is formed of a first conducting material. The first dipole arm extends in an axial direction from the first conductor. The second dipole arm is connected to a second conductor that is distinct from the first conductor and is formed of a second conducting material. The second dipole arm extends in the axial direction from the second conductor and is wound around the first dipole arm to form a number of loops. The second dipole arm does not contact the first dipole arm. An axial length of the second dipole arm in the axial direction is less than 90% of an axial length of the first dipole arm in the axial direction.

20 Claims, 16 Drawing Sheets

(56) References Cited

U.S. PATENT DOCUMENTS

| | | | |
|---|---|---|---|
| 5,810,803 | A | 9/1998 | Moss et al. |
| 5,973,653 | A | 10/1999 | Kragalott et al. |
| 6,051,018 | A | 4/2000 | Larsen |
| 7,118,590 | B1 | 10/2006 | Cronin |
| 7,194,297 | B2 | 3/2007 | Talpade et al. |
| 7,226,446 | B1 | 6/2007 | Mody et al. |
| 7,826,904 | B2 | 11/2010 | Appling et al. |
| 7,998,139 | B2 | 8/2011 | Rossetto et al. |
| 8,059,059 | B2 | 11/2011 | Bonn |
| 8,280,525 | B2 | 10/2012 | Rusin et al. |
| 8,414,570 | B2 | 4/2013 | Turner et al. |
| 8,617,153 | B2 | 12/2013 | Lee et al. |
| 9,375,275 | B2 | 6/2016 | Lee et al. |
| 9,700,374 | B2 | 7/2017 | Lee et al. |
| 2006/0189973 | A1 | 8/2006 | van der Weide |
| 2008/0266203 | A1 | 10/2008 | Rossetto et al. |
| 2009/0076492 | A1 | 3/2009 | Behnke |
| 2010/0057070 | A1 | 3/2010 | Behnke |
| 2010/0094272 | A1 | 4/2010 | Rossetto et al. |
| 2010/0097284 | A1 | 4/2010 | Brannan et al. |
| 2010/0125269 | A1 | 5/2010 | Emmons et al. |
| 2010/0168727 | A1 | 7/2010 | Hancock et al. |
| 2010/0185192 | A1 | 7/2010 | Muller et al. |
| 2010/0217252 | A1 | 8/2010 | Rossetto et al. |
| 2010/0228244 | A1 | 9/2010 | Hancock et al. |
| 2010/0268219 | A1 | 10/2010 | Ormsby et al. |
| 2010/0305561 | A1 | 12/2010 | Prakash et al. |
| 2011/0034917 | A1 | 2/2011 | Brannan |
| 2011/0208177 | A1 | 8/2011 | Brannan |
| 2011/0238060 | A1 | 9/2011 | Lee, Jr. et al. |
| 2014/0358140 | A1 | 1/2014 | Emmons |
| 2015/0250540 | A1 | 9/2015 | Behdad et al. |
| 2018/0219280 | A1* | 8/2018 | Fedan ..... H01Q 1/362 |
| 2018/0256251 | A1 | 9/2018 | Hagness et al. |
| 2018/0261922 | A1 | 9/2018 | Behdad et al. |

OTHER PUBLICATIONS

Luyen et al., A Minimally Invasive, Coax-fed Microwave Ablation Antenna With A Tapered-Slot Balun, Conference slides, IEEE International Symposium on Antennas and Propagation/USNC-URSI National Radio Science meeting, Jun. 26, 2016, Puerto Rico.

Brace et al., Dual-slot antennas for microwave tissue heating: Paramet- ric design analysis and experimental validation, Med. Phys., vol. 38, Jul. 2011, pp. 4232-4240.

R.W. Klopfenstein, A transmission line taper of improved design, Proceedings of the IRE, vol. 44. No. 1, 1956, pp. 31-35.

Choi et al., Development of a novel tapered balun for the UWB UHF coupler, IEEE Power Modulator Symp., 2004, pp. 493-496.

Duncan et al., 100:1 bandwidth balun transformer, Proceedings of the IRE, vol. 48, 1960, pp. 156-164.

Ito et al., Thin applicator having coaxial ring slots for interstitial microwave hyperthermia, IEEE AP-S Antennas Propagation Soc. Int. Symp. Dig., vol. 3, 1990, pp. 1233-1236.

Nwoye et al., Finite Element Analysis of Single Slot Antenna for Microwave Tumor Ablation, IOSR Journal of Applied Physics, vol. 5, Issue 6, Jan. 2014, pp. 55-62.

Mohtashami et al., A Minimally-Invasive Integrated Slot/Monopole Antenna for Generating Anisotropic Microwave Ablation Zones, IEEE International Symposium on Antennas and Propagation/USNC-URSI National Radio Science meeting, Jun. 26, 2016, Puerto Rico.

Mohtashami et al., A Minimally-Invasive Integrated Slot/Monopole Antenna for Generating Anisotropic Microwave Ablation Zones, Conference slides, IEEE International Symposium on Antennas and Propagation/USNC-URSI National Radio Science meeting, Jun. 26, 2016, Puerto Rico.

Açýkgöz et al., A Novel Microwave Coaxial Slot Antenna for Liver Tumor Ablation, Advanced Electromagnetics, vol. 3, No. 1, Apr. 2014.

Kitchin et al., Microwave ablation of malignant hepatic tumours: Intraperitoneal fluid instillation prevents collateral damage and allows more aggressive case selection, Int. J. Hyperthermia, vol. 30, No. 5, Aug. 20, 2014, pp. 299-305.

Oshima et al., Simultaneous microwave ablation using multiple antennas in explanted bovine livers: relationship between ablative zone and antenna, Radiation Medicine, vol. 26, No. 7, Aug. 2008, pp. 408-414.

Brace et al., Microwave ablation with multiple simultaneously powered small-gauge triaxial antennas: results from an in vivo swine liver model , Radiology, vol. 244, No. 1, Jul. 2007, pp. 151-156.

McWilliams et al., A Directional Interstitial Antenna for Microwave Tissue Ablation: Theoretical and Experimental Investigation, IEEE Trans. Biomed. Eng., vol. 62, No. 9, Sep. 2015, pp. 2144-2150.

Luyen et al., A balun-free helical an- tenna for minimally-invasive microwave ablation, IEEE Trans. Antennas Propag., vol. 63, No. 3, Mar. 2015, pp. 959-965.

Saito et al., Clinical trials of interstitial microwave hyperthermia by use of coaxial-slot antenna with two slots, IEEE Trans. Microw. Theory Tech., vol. 52, No. 8, Aug. 2004, pp. 1987-1991.

International Search Report and Written Opinion for Intl. Patent Appl. No. PCT/US2015/012615, dated May 1, 2015, 10 pp.

J Reinholm, The Characteristic Impedance of Coaxial Cables. Jun. 14, 2012. Electronics-lab.com, http://www.electronics-lab.com/the-characteristic-impedance-of-coaxial-cables/.

International Search Report and Written Opinion for PCT/US2018/067469, dated Apr. 18, 2019.

* cited by examiner

DIPOLE ANTENNA FOR MICROWAVE ABLATION

REFERENCE TO GOVERNMENT RIGHTS

This invention was made with government support under ECCS1406090 awarded by the National Science Foundation. The government has certain rights in the invention.

BACKGROUND

Microwave ablation (MWA) is a form of thermal ablation used in interventional radiology to treat cancer. MWA is known for its quicker patient recovery and fewer complications and can serve as an alternative when surgical resection cannot be applied. MWA uses electromagnetic waves in the microwave energy spectrum (300 megahertz to 300 gigahertz) to produce tissue-heating effects, i.e., to heat tumors to cytotoxic temperatures. MWA is generally used for minimally invasive treatment and/or palliation of solid tumors in patients. MWA offers several advantages over other ablation technologies such as radiofrequency (RF) and cryoablation including higher temperatures than RF, larger ablation zone volumes, shorter ablation times, and better ablation performance near arteries, which act as heat sinks. Selective delivery of energy to the prescribed tissue volume (i.e. the tumor and its margins) is achieved by means of interstitial placement of a microwave antenna directly into the tumor. Current MWA technology may be employed either laparoscopically or percutaneously, and thus, is considered to be minimally invasive. However, the extent to which MWA is minimally invasive depends on a length and a diameter of the interstitial microwave antenna. In general, a MWA antenna is expected to have a small overall diameter, a low reflection coefficient, and localized specific absorption rate (SAR) and heating patterns.

Most MWA antennas employ coaxial cables as their feed lines. Coaxial cable, however, is an unbalanced structure and current can flow on the outer surface of its outer conductor if the cable is not properly terminated. If not properly suppressed, this current can lead to unwanted heating of the healthy tissue along the insertion path of the antenna along the coaxial cable. This current can also cause the reflection coefficient of the antenna to be dependent on the insertion depth into the tissue.

Coaxial baluns have been the most ubiquitous solution for overcoming problems associated with the unbalanced currents flowing on the outer surface of the outer conductor of the coaxial cables. A coaxial balun is generally implemented by encompassing the outer conductor of the coaxial cable with another conducting cylinder. The inner surface of this extra cylinder and the outer surface of the outer conductor of the coaxial cable form a transmission line. The length of the balun and its termination are chosen such that a very large impedance is seen at the tip of the balun by the unbalanced currents. This high impedance prevents flow of unbalanced currents beyond the tip of the balun and greatly reduces the level of unwanted heating along the shaft of the antenna. While coaxial baluns help the antenna in providing a fairly localized SAR pattern, they increase the overall diameter and, as a result, the invasiveness of the MWA antenna.

A sector of the outer conductor of the coaxial cable along with its inner conductor may be extended beyond the feed point. These two extended conductors act as two arms of a dipole antenna, where each arm of the dipole may be a quarter of a wavelength long. Since currents flowing on the arms of this dipole antenna oppose each other, a very low feed point impedance is achieved. This very low feed point impedance almost shorts the current at the feed point and prevents its flow on the outer surface of the outer conductor. However, while unwanted current is effectively suppressed, the impedance match is poor requiring an impedance matching structure.

SUMMARY

In an example embodiment, an antenna is provided that includes, but is not limited to, a first dipole arm and a second dipole arm. The first dipole arm is connected to a first conductor and is formed of a first conducting material. The first dipole arm extends in an axial direction from the first conductor. The second dipole arm is connected to a second conductor that is distinct from the first conductor and is formed of a second conducting material. The second dipole arm extends in the axial direction from the second conductor and is wound around the first dipole arm to form a number of loops. The second dipole arm does not contact the first dipole arm. An axial length of the second dipole arm in the axial direction is less than 90% of an axial length of the first dipole arm in the axial direction In another example embodiment, an antenna system is provided that includes, but is not limited to, a coaxial cable and an antenna. The coaxial cable includes, but is not limited to, a center conductor extending a length of the coaxial cable, a dielectric material surrounding the center conductor along the length of the coaxial cable, and a conductive shield surrounding the dielectric material along the length of the coaxial cable. The antenna includes a first dipole arm and a second dipole arm. The first dipole arm is connected to the center conductor and is formed of a first conducting material. The first dipole arm extends in an axial direction from the center conductor. The second dipole arm is connected to the conductive shield that is distinct from the center conductor and is formed of a second conducting material. The second dipole arm extends in the axial direction from the conductive shield and is wound around the first dipole arm to form a number of loops. The second dipole arm does not contact the first dipole arm. An axial length of the second dipole arm in the axial direction is less than 90% of an axial length of the first dipole arm in the axial direction.

In yet another example embodiment, a microwave ablation system is provided that includes, but is not limited to, a coaxial cable, an antenna, a signal generator, and a connector. The coaxial cable includes, but is not limited to, a center conductor extending a length of the coaxial cable, a dielectric material surrounding the center conductor along the length of the coaxial cable, and a conductive shield surrounding the dielectric material along the length of the coaxial cable. The antenna includes a first dipole arm and a second dipole arm. The first dipole arm is connected to the center conductor and is formed of a first conducting material. The first dipole arm extends in an axial direction from the center conductor. The second dipole arm is connected to the conductive shield that is distinct from the center conductor and is formed of a second conducting material. The second dipole arm extends in the axial direction from the conductive shield and is wound around the first dipole arm to form a number of loops. The second dipole arm does not contact the first dipole arm. An axial length of the second dipole arm in the axial direction is less than 90% of an axial length of the first dipole arm in the axial direction.

Other principal features of the disclosed subject matter will become apparent to those skilled in the art upon review of the following drawings, the detailed description, and the appended claims.

BRIEF DESCRIPTION OF THE DRAWINGS

Illustrative embodiments of the disclosed subject matter will hereafter be described referring to the accompanying drawings, wherein like numerals denote like elements.

DETAILED DESCRIPTION

Figure 1:
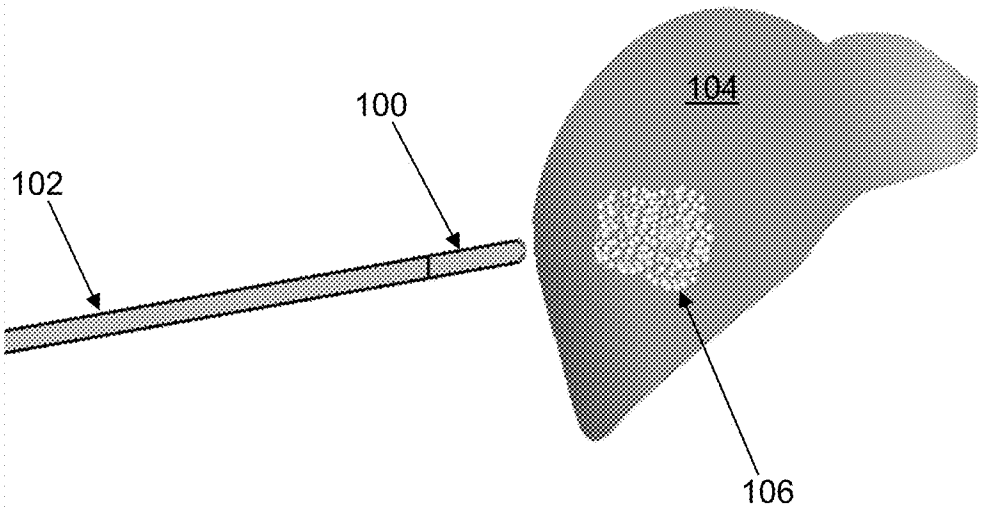
FIG. 1 depicts a microwave ablation (MWA) antenna system in accordance with an illustrative embodiment.

With reference to FIG. 1, a microwave ablation (MWA) antenna 100 is connected to and fed by a coaxial cable 102 that provides electromagnetic energy to antenna 100 at a selected operating frequency $f_o$. MWA can be used to provide thermal therapy for treatment of various types of cancer 106 in various tissue/organs 104. Tissue/organs 104 may include liver, kidney, lung, bone, etc. MWA uses microwave frequency in the range 300 megahertz (MHz) to 300 gigahertz (GHz), though 915 MHz and 2.45 GHz are most commonly used. MWA can be used to elevate the temperature of cancerous tissues to cytotoxic levels (e.g. >50° Celsius (C)) that quickly results in cell death. Electromagnetic waves are introduced into cancerous tissues by inserting antenna 100 interstitially into the tumor or other cancerous tissue.

Figure 2:
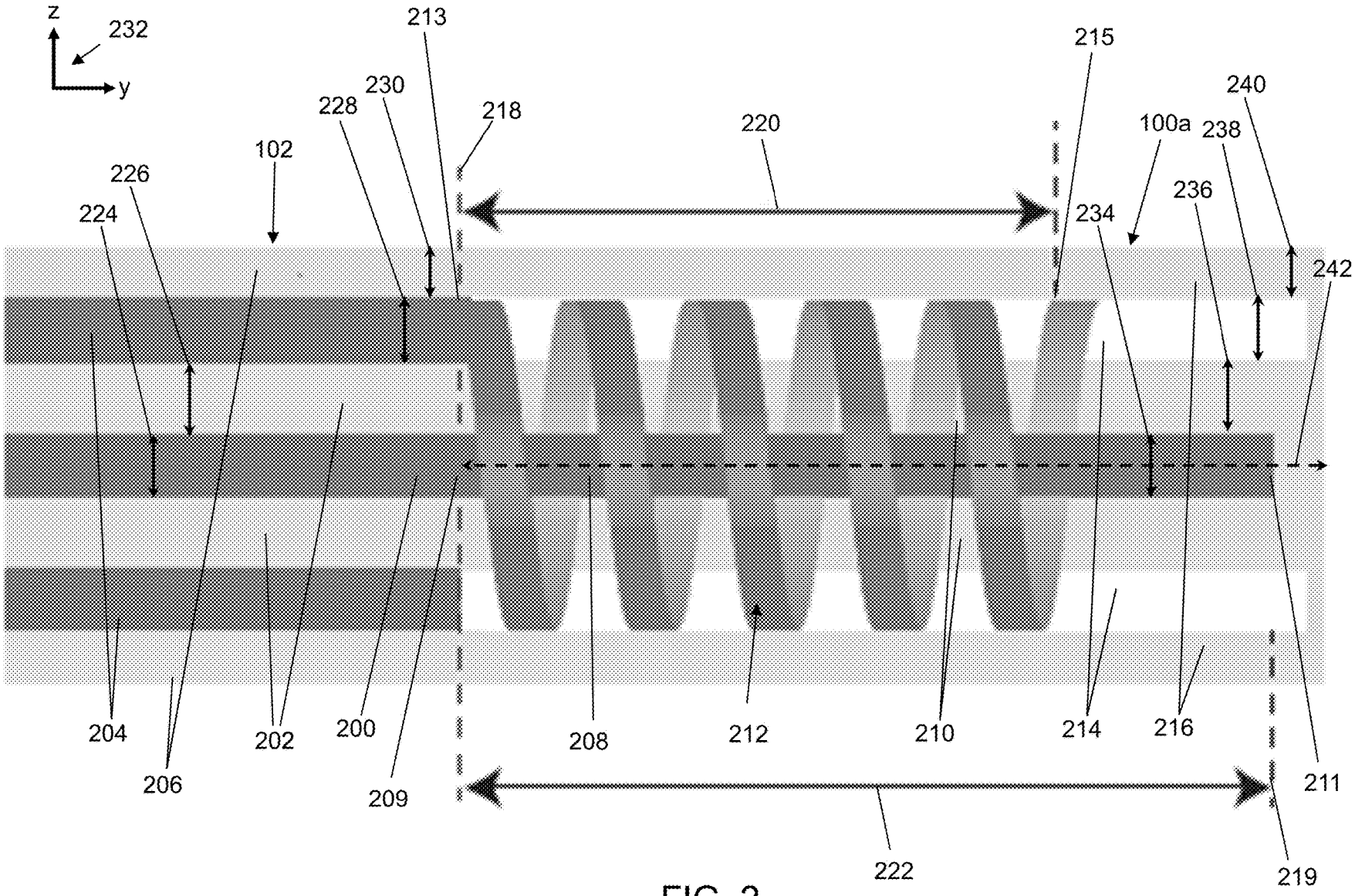
FIG. 2 depicts a side view of a first antenna for use in the MWA antenna system of FIG. 1 in accordance with an illustrative embodiment.
Figure 3:
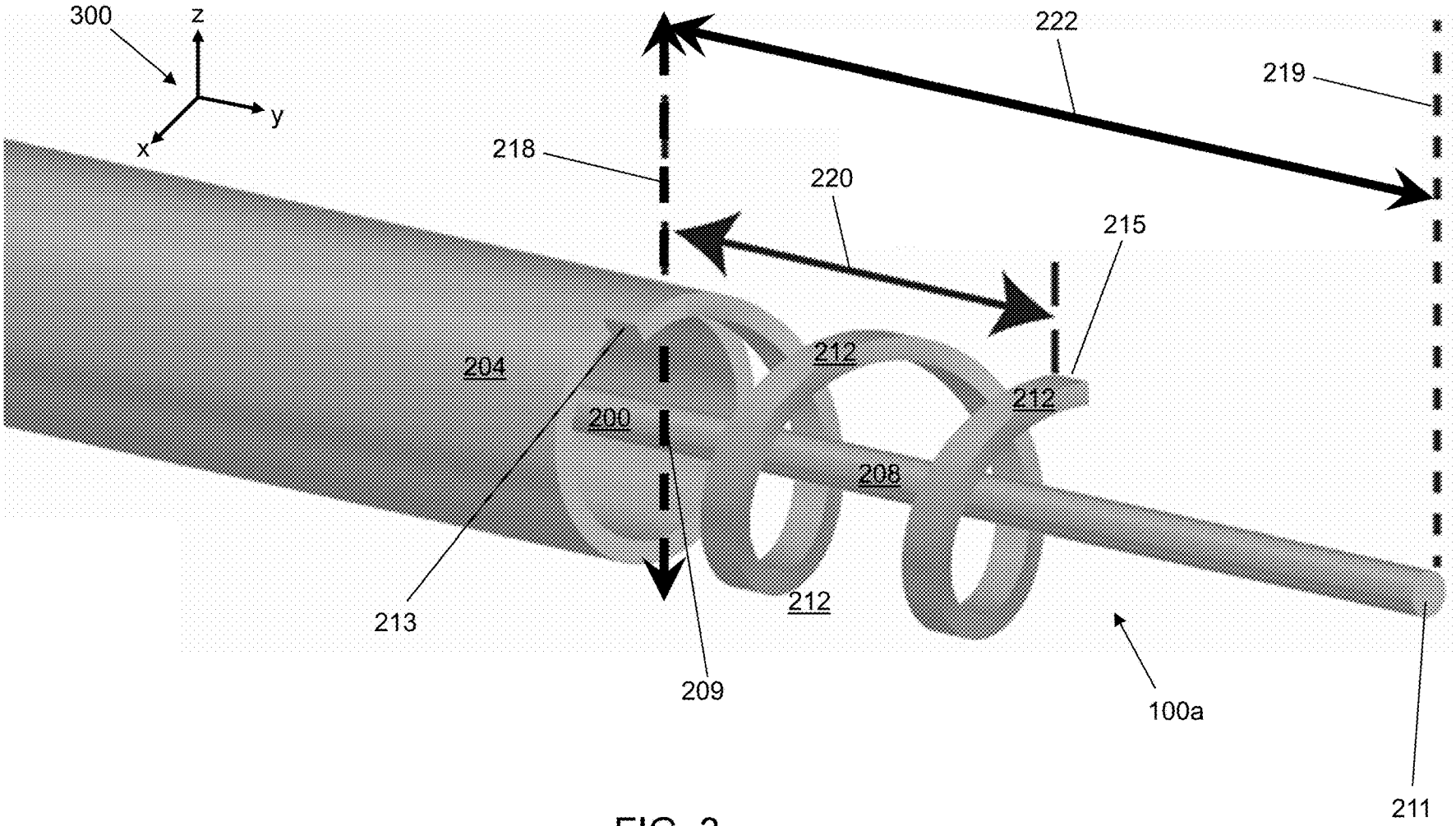
FIG. 3 depicts a perspective view of the first antenna of FIG. 2 in accordance with an illustrative embodiment.
Figure 4:
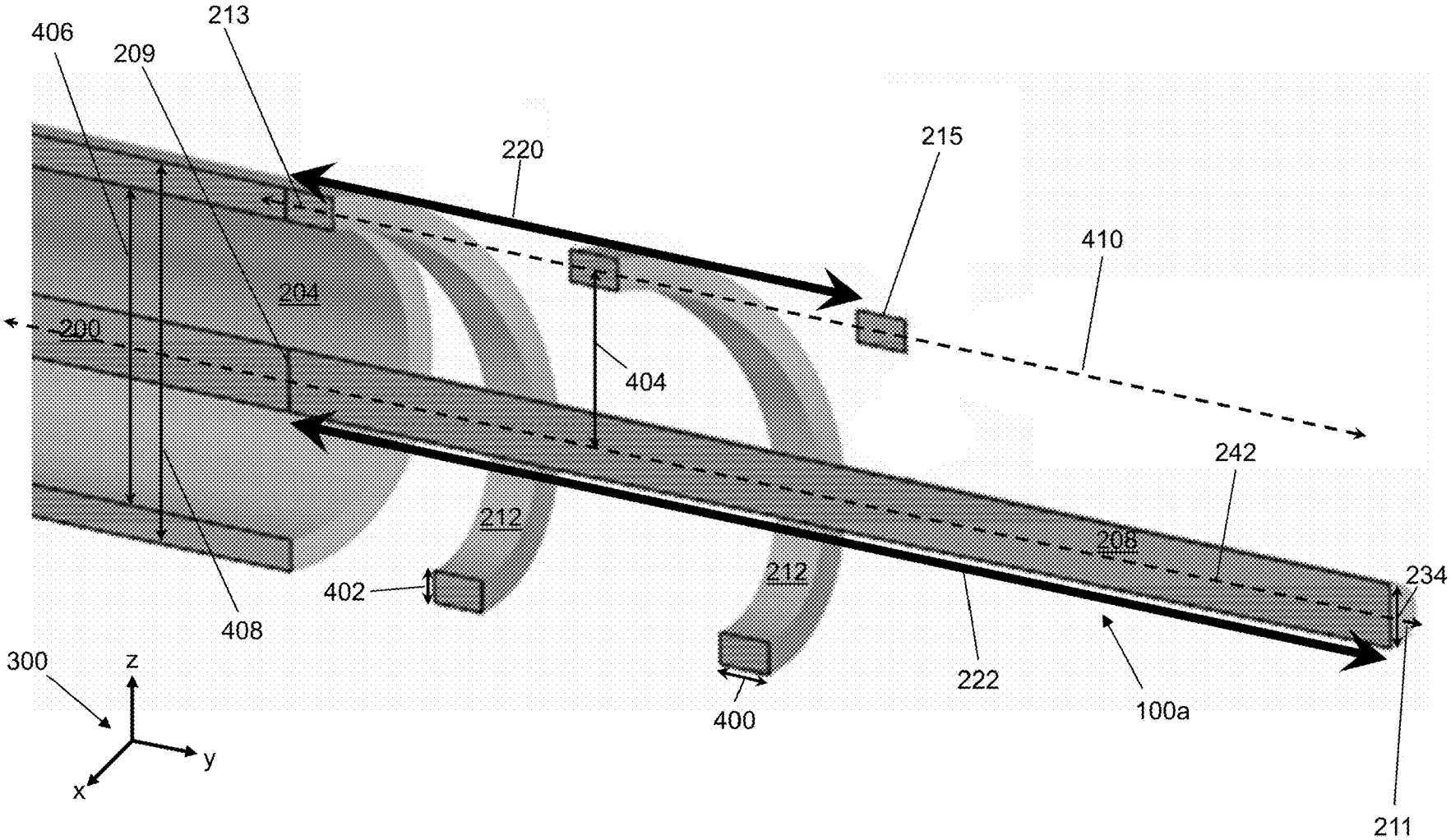
FIG. 4 depicts a lengthwise cross-sectional view of the first antenna of FIG. 2 in accordance with an illustrative embodiment.

With reference to FIG. 2, a side view of a first antenna 100*a* is shown in accordance with an illustrative embodiment. With reference to FIG. 3, a perspective view of first antenna 100*a* is shown in accordance with an illustrative embodiment. With reference to FIG. 4, a lengthwise cross-sectional view of first antenna 100*a* is shown in accordance with an illustrative embodiment. First antenna 100*a* connects to and extends from coaxial cable 102.

Coaxial cable 102 may include a center conductor 200 extending a length of coaxial cable 102, a dielectric material 202 surrounding center conductor 200 along the length of coaxial cable 102, a conductive shield 204 surrounding dielectric material 202 along the length of coaxial cable 102, and an insulating jacket 206 surrounding conductive shield 204 along the length of coaxial cable 102. Insulating jacket 206 may be a catheter in which first antenna 100*a* and all or a portion of coaxial cable 102 are inserted. Center conductor 200 is generally circular and may be formed of a solid conductive material such as copper plated steel wire, silver plated steel wire, silver plated copper wire, silver plated copper clad steel wire, copper wire, copper clad aluminum wire, steel wire, etc. Coaxial cable 102 may have a variety of diameters. Dielectric material 202 may include foamed polyethylene, solid polyethylene, polyethylene foam, polytetrafluoroethylene, air, air space polyethylene, vacuum, etc. Conductive shield 204 may be formed of a solid or braided conductive material such as copper, steel, aluminum, silver plated copper, silver plated copper clad steel, etc. Insulating jacket 206 can be made from many different insulating materials such as polyvinyl chloride or another plastic material. One or more of the materials may be biocompatible and suitable for insertion into living tissue.

Coaxial cable 102 may be formed of one or more rigid, semi-rigid, or flexible sections. The characteristic impedance may be off the shelf and range between approximately 20 and approximately 300 ohms or be designed to have a selected characteristic impedance within, above, or below this range as understood by a person of skill in the art using various dielectric and conductive materials, diameters, and thicknesses.

A center conductor width 224 defines a cross-section width of center conductor 200. When center conductor 200 has a circular cross-section, center conductor width 224 is a diameter of center conductor 200. For illustration, center conductor width 224 is approximately 0.51 millimeters (mm). A dielectric material width 226 defines a cross-section width of dielectric material 202 that surrounds center conductor 200. For illustration, dielectric material width 226 is approximately 0.58 mm. A conductive shield width 228 defines a cross-section width of conductive shield 204 that surrounds dielectric material 202. For illustration, conductive shield width 228 is approximately 0.36 mm. An insulating jacket width 230 defines a cross-section width of insulating jacket 206 that surrounds conductive shield 204. For illustration, insulating jacket width 230 is approximately 0.21 mm such that coaxial cable 102 has an outer diameter of approximately 2.8 mm. These dimensions yield the same impedance as that of commercially available semi-rigid coaxial cables (e.g. UT-085C) though other types of coaxial cable may be used in alternative embodiments.

First antenna 100*a* may form a dipole antenna that includes a first dipole arm 208 and a second dipole arm 212. In the illustrative embodiment of FIGS. 2 to 4, first dipole arm 208 is formed of a conductive material that may be the same material as and/or may be an extension of center conductor 200 of coaxial cable 102. First dipole arm 208 may be formed of conducting wire having one or more of a straight section, a helical section, etc. A cross-section of first dipole arm 208 may be circular, square, elliptical, rectangular, etc. though it is typically circular when formed as an extension of center conductor 200 of coaxial cable 102 as more clearly shown referring to FIGS. 3 and 4.

In the illustrative embodiment of FIGS. 2 to 4, first dipole arm 208 is formed of a single straight section of circular cross-section that extends between a first end 209 and a second end 211. First end 209 of first dipole arm 208 connects to center conductor 200 and extends in an axial direction illustrated by a center line 242 that extends lengthwise from center conductor 200 towards second end 211.

A first antenna dielectric material 210 may surround first dipole arm 208 along a length of first dipole arm 208 and around second end 211 of first dipole arm 208. First antenna dielectric material 210 may be the same material as and/or may be an extension of dielectric material 202.

A second antenna dielectric material 214 may surround first antenna dielectric material 210. A third antenna dielectric material 216 may surround second antenna dielectric material 214. Third antenna dielectric material 216 may be the same material as and/or may be an extension of insulating jacket 206. Third antenna dielectric material 216 may form a catheter body. For example, insulating jacket 206 and third antenna dielectric material 216 may be a catheter in which first antenna 100*a* and all or a portion of coaxial cable 102 are inserted. First antenna dielectric material 210, second antenna dielectric material 214, and third antenna dielectric material 216 may be selected from foamed polyethylene, solid polyethylene, polyethylene foam, polytetrafluoroethylene, air, air space polyethylene, vacuum, alumina, etc. For illustration, the dielectric materials may include any low loss dielectric materials having a permittivity relative to a vacuum within the range of 1 to 30. For illustration, first antenna dielectric material 210 and third antenna dielectric material 216 are polytetrafluoroethylene, and second antenna dielectric material 214 is air. One or more of first antenna dielectric material 210, second antenna dielectric material 214, and third antenna dielectric material 216 may be formed of the same dielectric material to form a continuous layer of material that surrounds first dipole arm 208 and/or second dipole arm 212.

In the illustrative embodiment of FIGS. 2 to 4, second dipole arm 212 is formed of a conductive material that may be the same material as and/or may be an extension of conductive shield 204 of coaxial cable 102. Second dipole arm 212 may be formed of conducting wire having one or more of a helical section, etc. A cross-section of second dipole arm 212 may be circular, square, elliptical, rectangular, etc. though it is typically rectangular when formed as an extension of conductive shield 204 of coaxial cable 102 as more clearly shown referring to FIGS. 3 and 4.

In the illustrative embodiment of FIGS. 2 to 4, second dipole arm 212 is formed of a single helix of rectangular cross-section that extends between a first end 213 and a second end 215. First end 213 of second dipole arm 212 connects to conductive shield 204 and forms a transition point between conductive shield 204 and second dipole arm 212. Second dipole arm 212 extends in an axial direction lengthwise from conductive shield 204 towards second end 215 of second dipole arm 212 forming a plurality of loops with first dipole arm 208 forming a center of each loop of the plurality of loops. In an illustrative embodiment, each loop has a circular shape when projected into a feed plane defined parallel to an x-z plane indicated by x-y-z reference frame 300 shown referring to FIG. 3. For example, referring to FIG. 2, second dipole arm 212 includes five complete circular loops; whereas, referring to FIGS. 3 and 4, second dipole arm 212 includes two complete circular loops. A number of loops or turns formed by second dipole arm 212 may be determined as discussed further below. A number of loops or turns need not be an integer value.

As understood by a person of skill in the art, the wavelength of operation, $\lambda_o$, of first antenna 100*a* is defined as $\lambda_o = c/f_o$, where c is the effective speed of light in the effective medium formed between first antenna dielectric material 210, second antenna dielectric material 214, insulating jacket 206, and an environment in which antenna 100 is used, such as a body tissue, and $f_o$ is a selected operating frequency of a signal carried by center conductor 200 of coaxial cable 102. For illustration, $f_o$, may be between 300 MHz and 300 GHz though 500 MHz and 30 GHz may be preferred. The wavelength of operation, $\lambda_o$, is a wavelength at the selected operating frequency in a medium in which first antenna 100*a* is selected to operate. For example, the medium also includes first antenna dielectric material 210, second antenna dielectric material 214, and third antenna dielectric material 216 as well as the body tissue into which antenna 100 is inserted to perform MWA.

First dipole arm 208 has a first dipole arm length 222 measured between the feed plane defined parallel to the x-z plane indicated by x-y-z reference frame 300 and an end plane also defined parallel to the x-z plane. For illustration, first dipole arm length 222 may be a multiple of $0.25\lambda_o$, such as $0.25\lambda_o$, $0.5\lambda_o$, $0.75\lambda_o$, etc. The feed plane and the end plane are perpendicular to an axial direction that is parallel to the y-axis of x-y-z reference frame 300. Center line 242 is also parallel to the y-axis.

Second dipole arm 212 has a second dipole arm length 220 measured between the feed plane and second end 215 of second dipole arm 212 in direction that is parallel to the y-axis. First dipole arm length 222 is also measured from the feed plane in a direction that is parallel to the y-axis. Selection of second dipole arm length 220 is discussed further below. FIG. 2 shows first antenna 100*a* in the y-z reference frame 232. The feed plane includes a feed vector 218 that extends radially from a center of first dipole arm 208 at a transition point or connection point between center conductor 200 of coaxial cable 102 and first end 209 of first dipole arm 208. The end plane includes second end 211 of first dipole arm 208. An end vector 219 extends radially from a center of first dipole arm 208 through second end 211 of first dipole arm 208. As a result, first dipole arm length 222 is measured between feed vector 218 and end vector 219 that is defined by a distal end of first dipole arm 208.

Feed vector 218 also extends through an edge of first end 213 of second dipole arm 212 that connects to conductive shield 204. First end 209 of first dipole arm 208 is a feed end of first dipole arm 208. First end 213 of second dipole arm 212 is a feed end of second dipole arm 212. First dipole arm 208 and second dipole arm 212 are not connected to and do not contact or touch each other at any point.

A first dipole arm width 234 defines a cross-section width of first dipole arm. When first dipole arm 208 has a circular cross-section, first dipole arm width 234 is a diameter of first dipole arm 208. For illustration, first dipole arm width 234 is equal to center conductor width 224 and is approximately 0.51 millimeters (mm). A first antenna dielectric material width 236 defines a cross-section width of first antenna dielectric material 210 that surrounds first dipole arm 208. For illustration, first antenna dielectric material width 236 is equal to dielectric material width 226 and is approximately 0.58 mm. A second antenna dielectric material width 238 defines a cross-section width of second antenna dielectric material 214 that surrounds first antenna dielectric material 210. For illustration, second antenna dielectric material width 238 is equal to conductive shield width 228 and is approximately 0.36 mm. A third antenna dielectric material width 240 defines a cross-section width of third antenna dielectric material 216 that surrounds second antenna dielectric material 214. For illustration, third antenna dielectric material width 240 is equal to insulating jacket width 230 and is approximately 0.21 mm such that first antenna 100*a* also has an outer diameter of approximately 2.8 mm. No balun is used with first antenna 100*a* so that first antenna 100*a* is minimally invasive based on the wavelength of operation, $\lambda_o$, selected for use to perform MWA.

Referring to FIG. 4, a second dipole arm cross-section length 400 defines a cross-section length of a conductor that forms second dipole arm 212, and a second dipole arm cross-section width 402 defines a cross-section width of the conductor that forms second dipole arm 212. For illustration, second dipole arm cross-section length 400 is selected to be equal to first dipole arm width 234; and second dipole arm cross-section width 402 is selected to be equal to second antenna dielectric material width 238. Of course, if the conductor that forms second dipole arm 212 has a circular cross-section, second dipole arm cross-section length 400 is equal to second dipole arm cross-section width 402 and both are a diameter of the circular cross-section. In the illustrative embodiment, second dipole arm cross-section length 400 is approximately equal to 0.51 mm, and second dipole arm cross-section width 402 is approximately equal to 0.36 mm.

A separation width 404 defines a radial separation distance between a center of first dipole arm 208 defined by center line 242 and a center of second dipole arm 212 defined by a second center line 410. Separation width 404 may vary as it is measured radially around first dipole arm 208 depending on a shape of the conductor of first dipole arm 208 and the conductor of second dipole arm 212 and on a shape formed by first dipole arm 208 and second dipole arm 212. Separation width 404 is measured in a plane that is parallel to the x-z plane and can be used for a complete loop or turn of second dipole arm 212 to compute a mean value.

An overall length of the conductor of second dipole arm 212 can be computed using $l_t=\sqrt{l_h^2+(\pi ND)^2}$, where $l_t$ is the overall length, $l_h$ is second dipole arm length 220, N is the number of loops or turns of second dipole arm 212, and D is a mean value of an inner diameter 406 of conductive shield 204 and an outer diameter 408 of conductive shield 204. D is also twice separation distance 404. Second dipole arm length 220 $l_h$ is selected to simultaneously have a simulated reflection coefficient, $|S_{11}|$, that is less than −10 dB, and a compact specific absorption rate (SAR) pattern at the selected operating frequency $f_o$. To achieve this, second dipole arm length 220 $l_h$ is less than first dipole arm length 222 by at least 10% of first dipole arm length 222 such that $l_h \leq 0.9*l_m$, where $l_m$ is first dipole arm length 222.

Second dipole arm length 220 is selected such that a good impedance match and a localized SAR pattern is achieved at the frequency of operation. Second dipole arm length 220 $l_h$ can be chosen between $0.1\lambda_o$ to $0.2\lambda_o$, inclusive. The overall length $l_t$ is selected to be $0.25\lambda_o+m*0.5\lambda_o$, where m=0, 1, 2, . . . subject to fine-tuning as understood by a person of skill of art. For illustration, the overall length $L_t$ may be selected as $0.25\lambda_o$, $0.75\lambda_o$, $1.25\lambda_o$, $1.75\lambda_o$, etc. N can be determined using $N=\sqrt{l_t^2-l_h^2}/(\pi D)$.

Figure 5A:
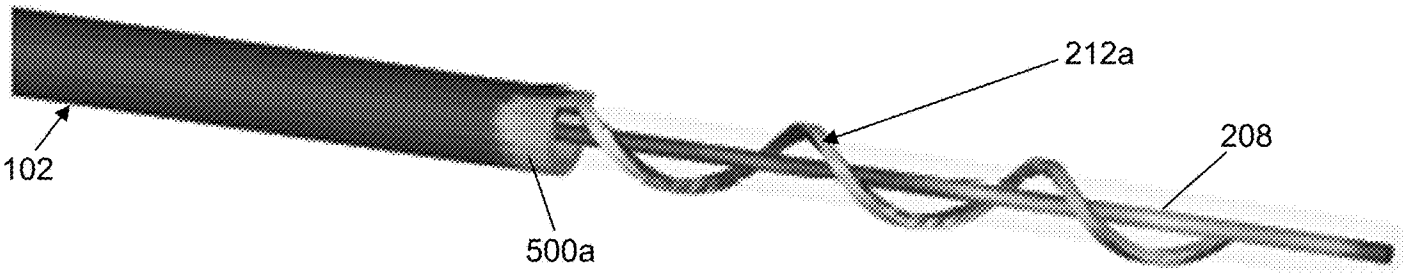
FIGS. 5A-5D depict perspective views of the first antenna of FIG. 2 with different numbers of turns of a helix portion in accordance with an illustrative embodiment.
Figure 5B:
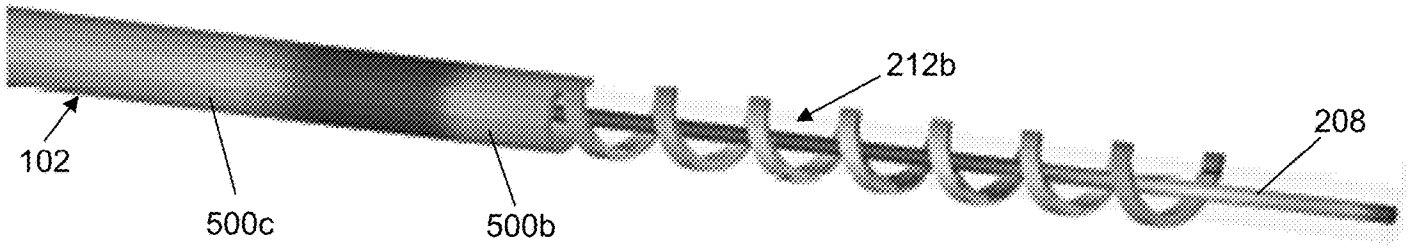
Figure 5C:
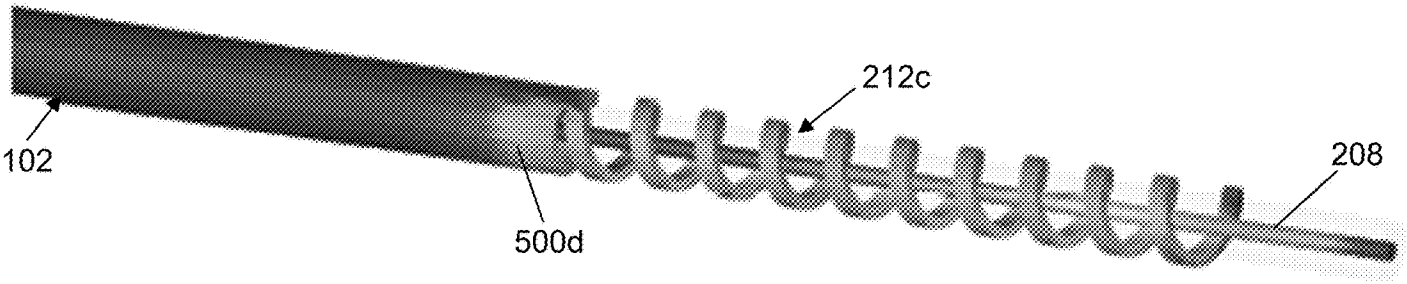
Figure 5D:
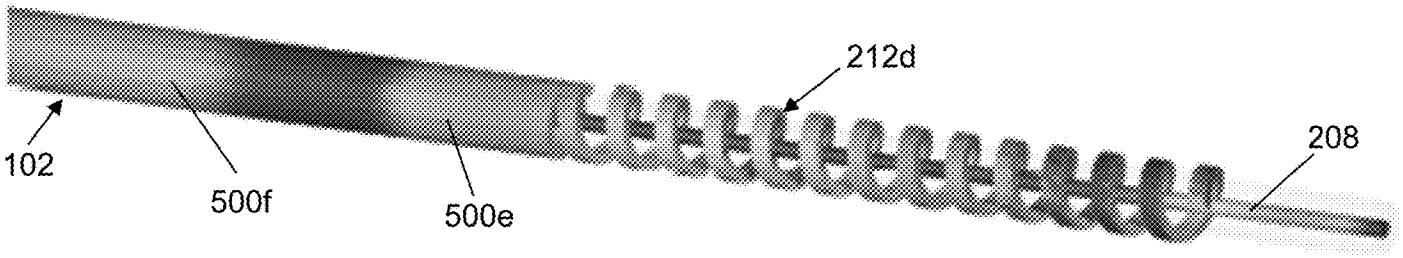

Referring to FIGS. 5A to 5D, perspective views of first antenna 100*a* with different numbers of turns N of second dipole arm 212 are shown for integer multiples $N_m$ of $l_t=N_m\lambda_o/4$ in accordance with an illustrative embodiment. Referring to FIG. 5A, $l_t=\lambda_o/4$ was used, and the equation $N=\sqrt{l_t^2-l_h^2}/(\pi D)$ was solved to compute N=2.7 for second dipole arm 212*a*. Referring to FIG. 5B, $l_t=\lambda_o/2$ was used, and the equation $N=\sqrt{l_t^2-l_h^2}/(\pi D)$ was solved to compute N=7.1 for second dipole arm 212*b*. Referring to FIG. 5C, $l_t=3\lambda_o/4$ was used, and the equation $N=\sqrt{l_t^2-l_h^2}/(\pi D)$ was solved to compute N=9.9 for second dipole arm 212*c*. Referring to FIG. 5D, $l_t=\lambda_o$ was used, and the equation $N=\sqrt{l_t^2-l_h^2}/(\pi D)$ was solved to compute N=13.2 for second dipole arm 212*d*.

A current flowing on an outer surface of conductive shield 204 was substantially reduced for $l_t$ having odd values for integer multiples $N_m$. For example, a first region 500*a*, shown referring to FIG. 5A, had a normalized current density between ~−22 decibels (dB) and ~−28 dB for $l_t=\lambda_o/4$ for second dipole arm 212*a* in an illustrative embodiment. Remaining regions of coaxial cable 102 connected to second dipole arm 212*a* had a normalized current density less than ~−28 dB.

A second region 500*b* and a third region 500*c* had a normalized current density between ~−22 decibels (dB) and ~−24 dB for $l_t=\lambda_o/2$ for second dipole arm 212*b* in the illustrative embodiment shown referring to FIG. 5B. Remaining regions of coaxial cable 102 connected to second dipole arm 212*b* had a normalized current density less than ~−24 dB.

A fourth region 500*d* had a normalized current density between ~−22 decibels (dB) and ~−28 dB for $l_t=3\lambda_o/4$ for second dipole arm 212*c* in the illustrative embodiment shown referring to FIG. 5C. Remaining regions of coaxial cable 102 connected to second dipole arm 212*c* had a normalized current density less than ~−28 dB.

A fifth region 500*e* and a sixth region 500*f* had a normalized current density between ~−22 decibels (dB) and ~−24 dB for $l_t=\lambda_o$ for second dipole arm 212*d* in the illustrative embodiment shown referring to FIG. 5D. Remaining regions of coaxial cable 102 connected to second dipole arm 212*d* had a normalized current density less than ~−24 dB.

To maintain a localized SAR pattern while obtaining a decent impedance (less than −10 dB) match, $l_t=3\lambda_o/4$ is selected as an optimal value. Using $l_t=3\lambda_o/4$, a current direction along second dipole arm 212 reverses a distance equal to $\lambda_o/4$ away from the feed end of second dipole arm 212 becoming aligned with the current direction along first dipole arm 208. As a result, an input impedance of first antenna 100*a* increases and the impedance match with coaxial cable 102 improves. Wrapping second dipole arm 212 around first dipole arm 208 also helps first antenna 100*a* produce symmetric SAR patterns.

Using the provided illustrative dimensions for coaxial cable 102 and first antenna 100*a*, and selecting the operating frequency as 1.9 gigahertz (GHz), $l_m$=23 mm was chosen for first dipole arm length 222, and an optimized value of $l_h$=18 mm was chosen for second dipole arm 212 or $l_h \leq 0.783*l_m$ making second dipole arm length 220 $l_h$ 21.7% less than first dipole arm length 222. The frequency of 1.9 GHz was chosen because the power amplifier used in experiments worked in the 1.8 GHz to 2 GHz range. This frequency is close to the 2.45 GHz ISM band that is commonly used in commercial MWA systems. The results presented herein relative to first antenna 100*a* are expected to be applicable to other operating frequencies including 2.45 GHz. Full-wave electromagnetic (EM) simulations were performed using CST Microwave Studio to design first antenna 100*a* for operation in egg white. Egg white was chosen because it simplifies real-time monitoring of an ablation zone as it forms. The frequency-dependent dielectric properties of egg white were measured using an Agilent vector network analyzer (E8364A) and an Agilent dielectric probe kit (85070E). These properties were imported into CST Microwave Studio for running the full-wave EM simulations.

Second dipole arm cross-section length 400 $l_c$=0.51 mm was selected as mentioned previously because a longer length degrades the simulated reflection coefficient, $|S_{11}|$, and a shorter length decreases a power handling capability of second dipole arm 212. Therefore, $l_c$=0.51 mm—the same value as first dipole arm width 234—provided a good compromise between the power handling capability, low simulated reflection coefficient ($|S_{11}|$) and a localized SAR pattern. $l_t=3\lambda_o/4$ was used as discussed previously resulting in N=9.9 for second dipole arm 212*c* computed by solving $$N = \sqrt{l_t^2 - l_h^2} \Big/ (\pi D) \text{ with } D = \frac{1.67 + 2.38}{2} = 2.025 \text{ m},$$

which is also twice separation distance 404.

Figure 6:
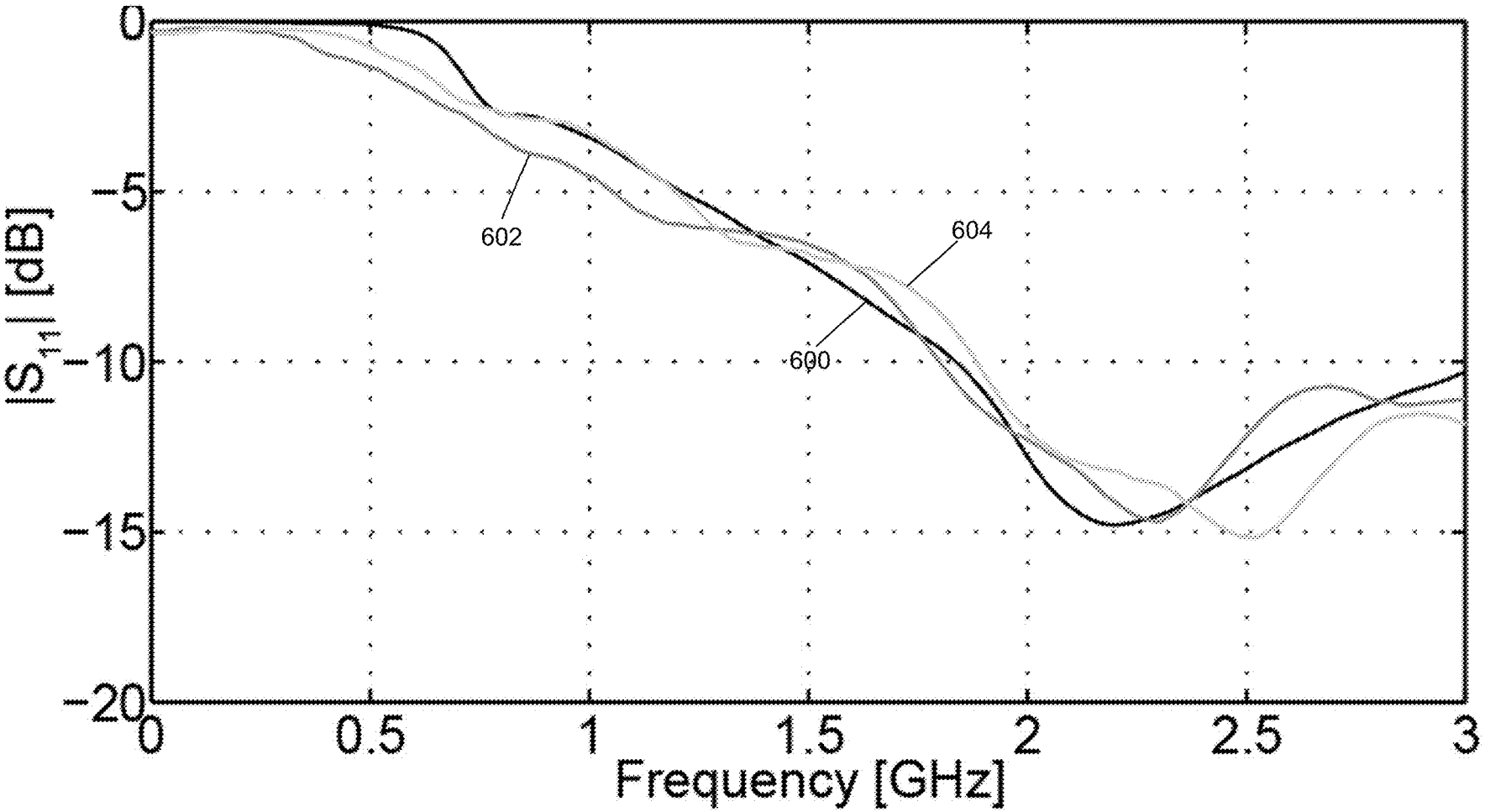
FIG. 6 shows a simulated reflection coefficient, $|S_{11}|$, of the first antenna of FIG. 5C in accordance with an illustrative embodiment.

Referring to FIG. 6, simulated and measured reflection coefficient, $|S_{11}|$, of first antenna 100*a* with N=9.9 for second dipole arm 212 are shown. A first $|S_{11}|$ curve 600 shows the simulated $|S_{11}|$ as a function of operating frequency. A second $|S_{11}|$ curve 602 shows a pre-ablation measured $|S_{11}|$ as a function of operating frequency. A third $|S_{11}|$ curve 604 shows a post-ablation measured $|S_{11}|$ as a function of operating frequency. The $|S_{11}|$ curves 600, 602, and 604 show that first antenna 100*a* is well matched at 1.9 GHz with an $|S_{11}|$ value of −11 dB without using an internal impedance matching network.

Figure 7:
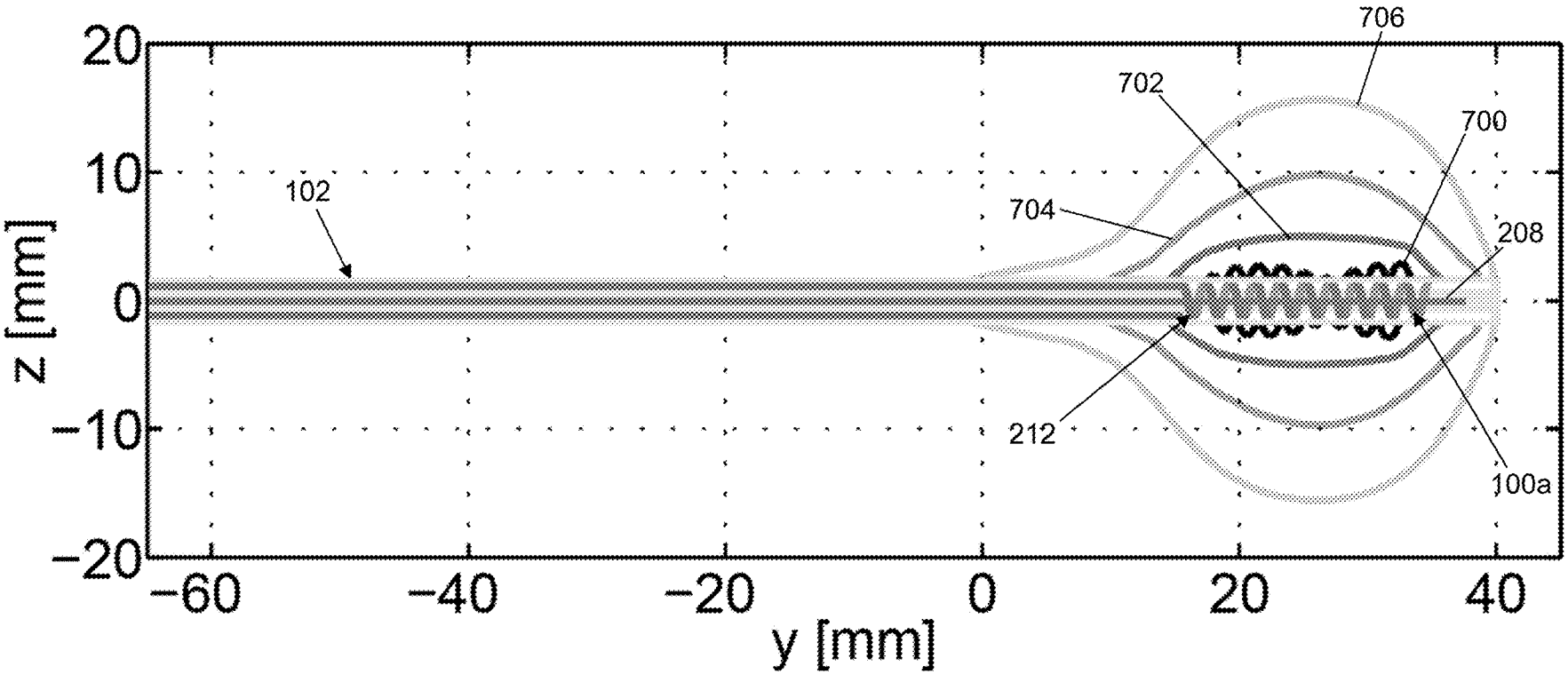
FIG. 7 shows a simulated, normalized specific absorption rate (SAR) pattern of the first antenna of FIG. 5C in the y-z plane in accordance with an illustrative embodiment.

Referring to FIG. 7, a normalized SAR pattern of first antenna 100*a* with N=9.9 for second dipole arm 212 is shown in the y-z plane. The SAR pattern was normalized to its associated maximum value. The simulated results assumed egg white. A −5 decibel (dB) curve 700 shows a SAR level reduced by 5 dB. A −10 dB curve 702 shows a SAR level reduced by 10 dB. A −15 dB curve 704 shows a SAR level reduced by 15 dB. A −20 dB curve 706 shows a SAR level reduced by 20 dB. First antenna 100*a* and coaxial cable 102 are shown for reference. The results of FIG. 7 show that first antenna 100*a* generates a symmetric SAR pattern. The SAR pattern is compact and almost confined to a longitudinal extent of first dipole arm 208 and second dipole arm 212. This efficient confinement eliminates the need for a balun thus reducing an overall form factor and invasiveness of first antenna 100*a*.

Figure 8:
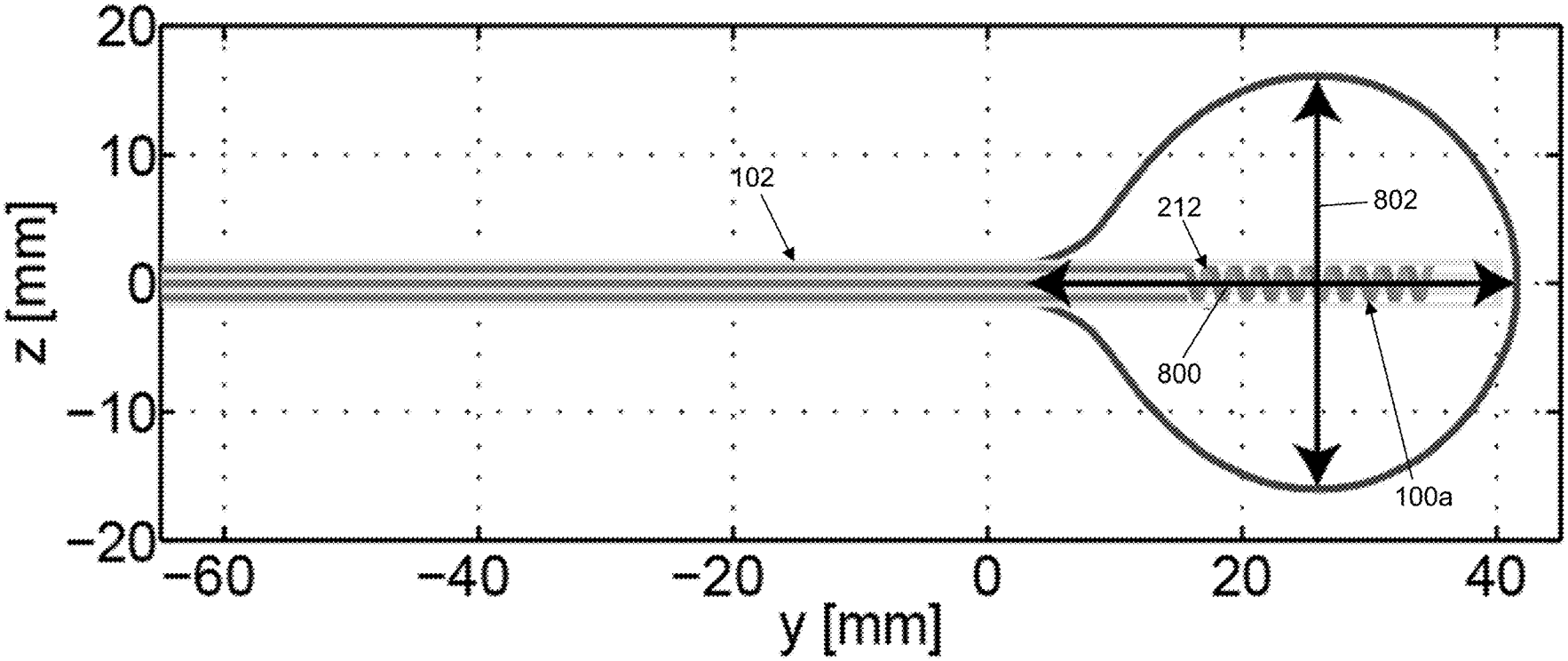
FIG. 8 shows a simulated ablation zone of the first antenna of FIG. 5C in the y-z plane in accordance with an illustrative embodiment.

Referring to FIG. 8, a simulated ablation zone of first antenna 100*a* is shown in the y-z plane. The simulated ablation zone has an ablation length 800 and an ablation width 802. First antenna 100*a* and coaxial cable 102 are shown for reference. The SAR pattern generated for egg white for first antenna 100*a* operating at 1.9 GHz was imported into CST Multiphysics Suite to serve as a thermal source for transient thermal simulations with a scaled power of 40 watts (W). In the simulations, the initial temperature of the egg white was set to 25 degrees Celsius (C). The thermal properties of egg white were defined as a thermal conductivity of 0.55 watts/kelvin/meter (W/K/m), a heat capacity of 3.8 kilojoules/K/kilogram (kJ/K/kg), and a density of 1041 kg/m$^3$. The simulated ablation zone shown in FIG. 8 was determined after simulating 5 minutes of ablation. Ablation length 800 and ablation width 802 represent a 60 degrees C. contour, which is a median temperature of a congestion zone and was selected to define the boundary of the ablation zone. As FIG. 8 shows, first antenna 100*a* operating at 1.9 GHz produces an approximately spherical ablation zone with no tail observed along an insertion path of first antenna 100*a*. To quantify a degree of sphericity of the ablation zone, an axial ratio (AR) was defined as a ratio of ablation length 800 to ablation width 802. A value of one indicates a completely spherical ablation zone. For first antenna 100*a* operating at 1.9 GHz, an AR equal to 1.15 was computed indicating a nearly spherical ablation zone.

A prototype of first antenna 100*a* operating at 1.9 GHz was fabricated. Laser fabrication technology was used to fabricate second dipole arm 212 out of C122 seamless round copper tube with inner and outer diameters of 1.67 mm and 2.38 mm, respectively. The fabricated second dipole arm 212 was soldered to a UT-085C semi-rigid coaxial cable that was used to feed first antenna 100*a*. The inner diameter of conductive shield 204 was 1.67 mm (the same value as the C122 copper tube) and as a result, the soldered joint did not adversely affect the performance of first antenna 100*a*. Insulating jacket 206 and third antenna dielectric material 216 were formed using a fluorinated ethylene propylene heat shrink the far end of which was sealed by epoxy to completely envelop first antenna 100*a*. After the epoxy cured for 48 hours, a heat gun was used to shrink a diameter of the heat shrink to 2.8 mm. Before conducting an ablation experiment, first antenna 100*a* was placed inside egg white and its pre-ablation $|S_{11}|$ was measured using a vector network analyzer (Agilent E5071C). Second $|S_{11}|$ curve 602 of FIG. 6 shows the measured results. First $|S_{11}|$ curve 600 that was simulated and second $|S_{11}|$ curve 602 that was measured agree reasonably well with the fabricated first antenna 100*a* having $|S_{11}|$ of −12 dB at 1.9 GHz. The differences between first $|S_{11}|$ curve 600 that was simulated and second $|S_{11}|$ curve 602 that was measured can be attributed to fabrication tolerances and uncertainties in the dielectric properties of the egg white.

The fabricated first antenna 100*a* was used to perform an ablation experiment in egg white. An output of a signal generator (HP 8350B sweep oscillator) was fed as an input to a solid-state power amplifier (DMS 7066). An output of the amplifier was fed to coaxial cable 102 that fed the fabricated first antenna 100*a*. The ablation experiment was performed at 1.9 GHz for 5 minutes at a power level of 40 W. The $|S_{11}|$ of the fabricated first antenna 100*a* was monitored during the ablation experiment using a circulator and a power meter. The level of $|S_{11}|$ was observed to be less than −10 dB during the entire ablation process, which indicates that fabricated first antenna 100*a* remained matched to coaxial cable 102 as the dielectric properties of the egg white changed. This observation is in agreement with the measured post-ablation $|S_{11}|$ shown in third $|S_{11}|$ curve 604 of FIG. 6. The $|S_{11}|$ value changed from a pre-ablation value of −12 dB to a post-ablation value of −10.5 dB at 1.9 GHz.

Figure 9B:
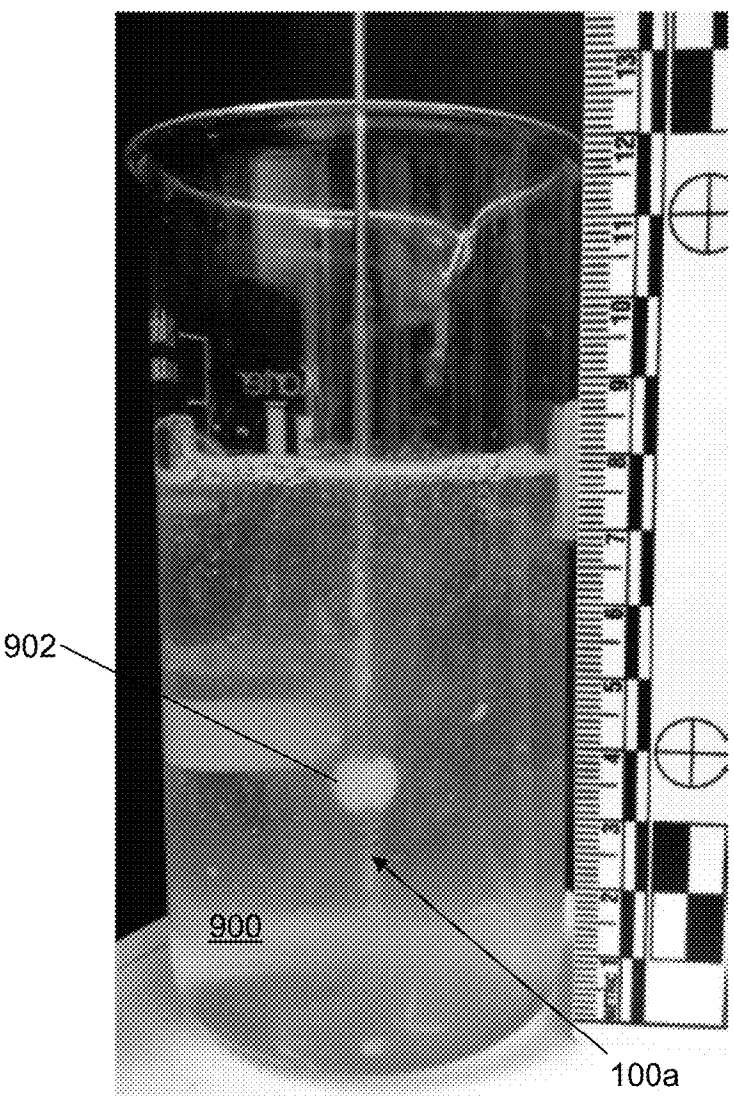
FIGS. 9A-9D show snapshots of the ablation zone of the first antenna of FIG. 5C in egg white in accordance with an illustrative embodiment.
Figure 9A:
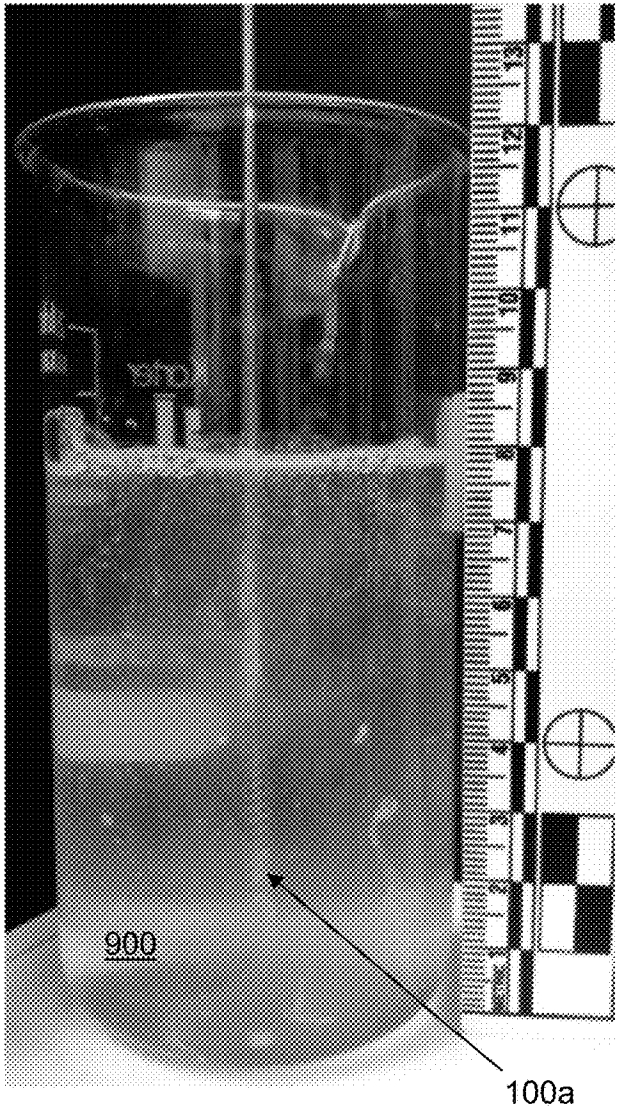

Referring to FIGS. 9A to 9D, snapshots of the ablation zone generated by fabricated first antenna 100*a* in egg white 900 are shown at four different time points. FIG. 9A shows egg white 900 at ablation time $t_a$=0. FIG. 9B shows egg white 900 with a first ablation zone 902 at $t_a$=60 seconds.

Figure 9D:
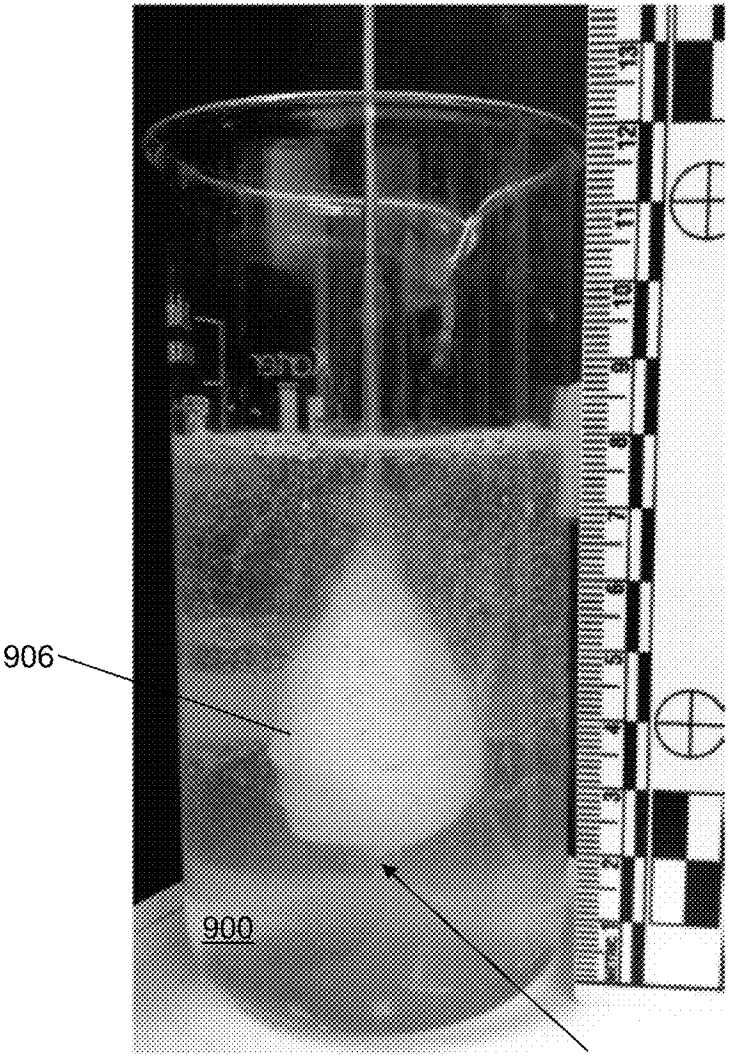
Figure 9C:
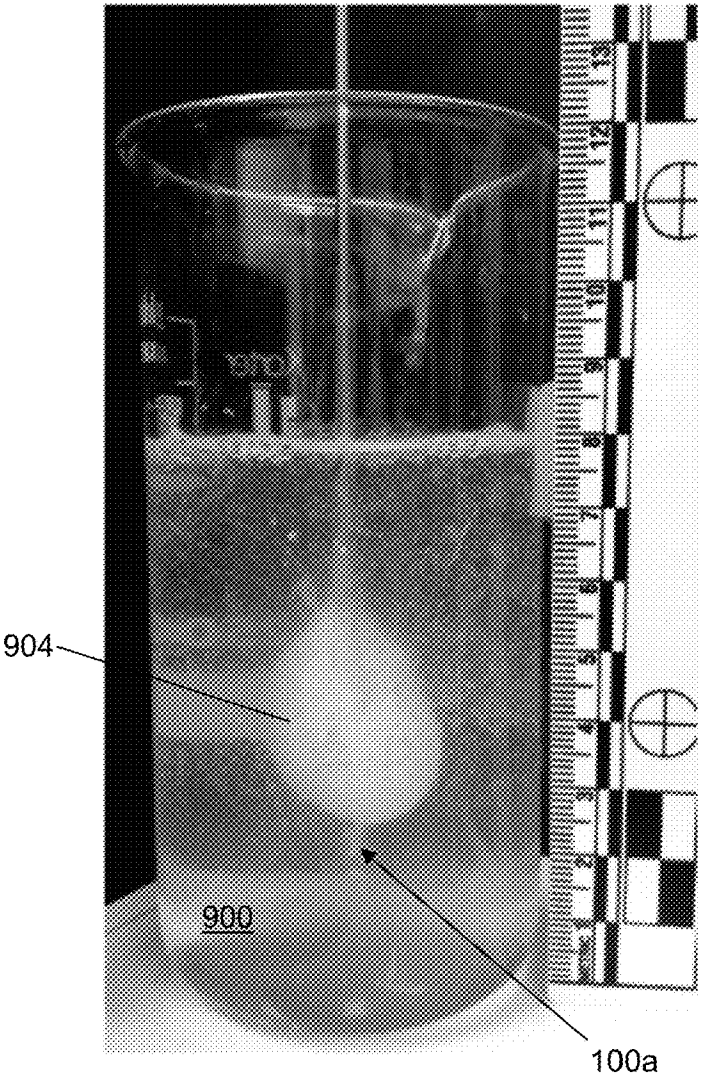

FIG. 9C shows egg white 900 with a second ablation zone 904 at $t_a$=180 seconds. FIG. 9D shows egg white 900 with a third ablation zone 906 at $t_a$=300 seconds. The evolution of the ablation zone can be seen clearly. The produced ablation zone is localized and no tail is observed along the insertion path of fabricated first antenna 100*a*. The longitudinal and lateral expansions of the ablation zone after five minutes of ablation were 4.0 cm and 3.2 cm, respectively. The axial ratio of the produced ablation zone was calculated to be 1.25, indicating a fairly spherical ablation zone. In fact, as FIGS. 9A to 9D show, the ablation zone of first antenna 100*a* maintained a fairly spherical shape during the entire ablation process and the dimensions of the ablation zone closely follow those of the simulation (3.8×3.3 $cm^2$) confirming the capability of first antenna 100*a* to produce localized ablation zones. Several phenomena occur during MWA that were not modeled in the simulations due to a lack of proper models and due to software limitations (i.e. charring, water vapor generation, vapor condensation). Together these result in the small discrepancies that can be seen between the dimensions of the ablation zones in the simulation and the experiment.

Figure 10:
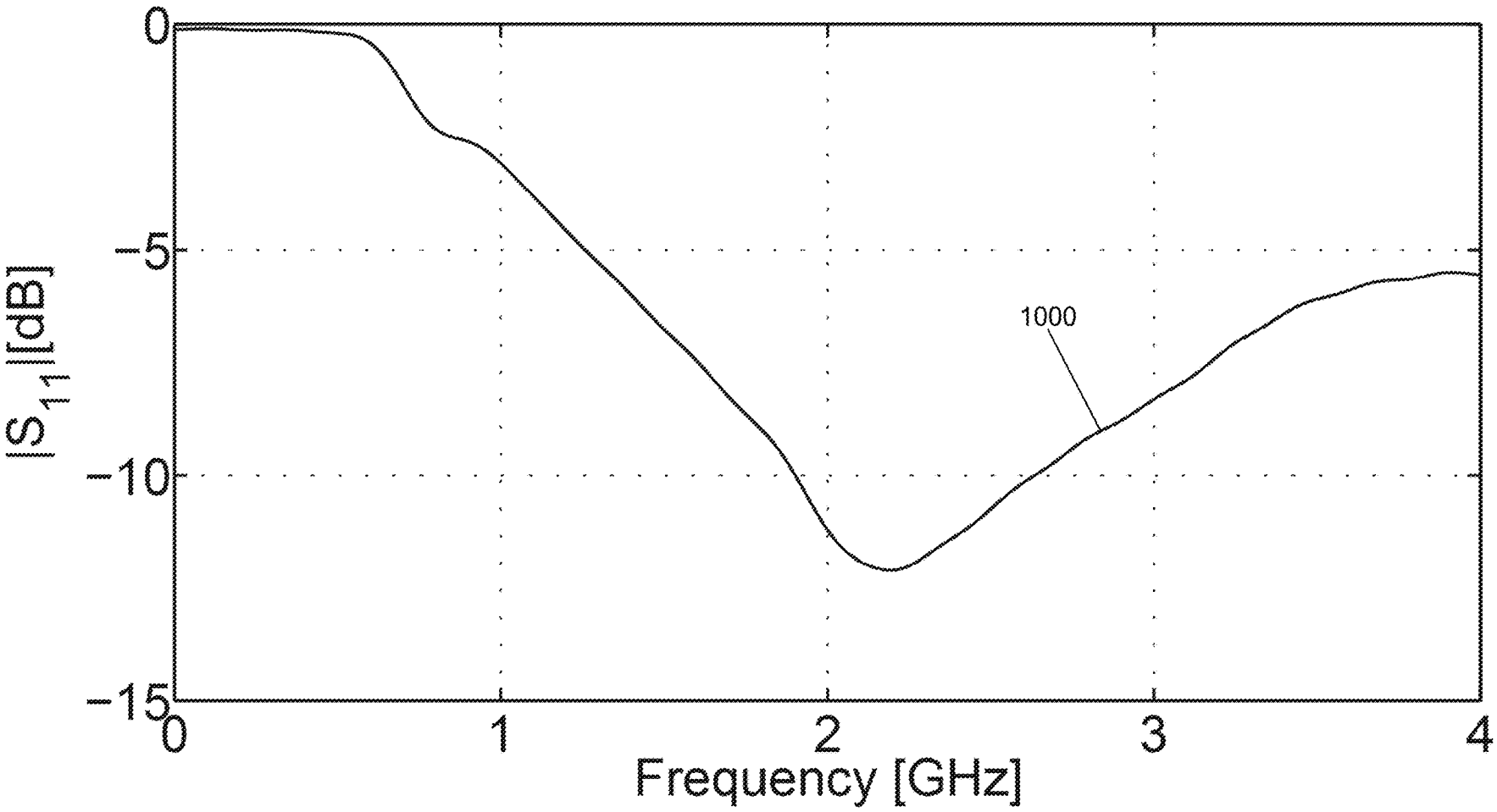
FIG. 10 shows a simulated reflection coefficient, $|S_{11}|$, of a modified MWA antenna for comparison.

Referring to FIG. 10, a simulated reflection coefficient, $|S_{11}|$, of a modified MWA antenna is shown by a fourth $|S_{11}|$ curve 1000. The modified MWA antenna was identical to first antenna 100*a* except $l_m=l_h$=23 mm was used with N=9.9, which still corresponds to $l_t=3\lambda_o/4$. The simulated reflection coefficient, $|S_{11}|$, at 1.9 GHz was −9 dB, which is unacceptable because it should be below −10 dB. For comparison, the simulated reflection coefficient, $|S_{11}|$, at 1.9 GHz was −11.5 dB for first antenna 100*a*.

Figure 11:
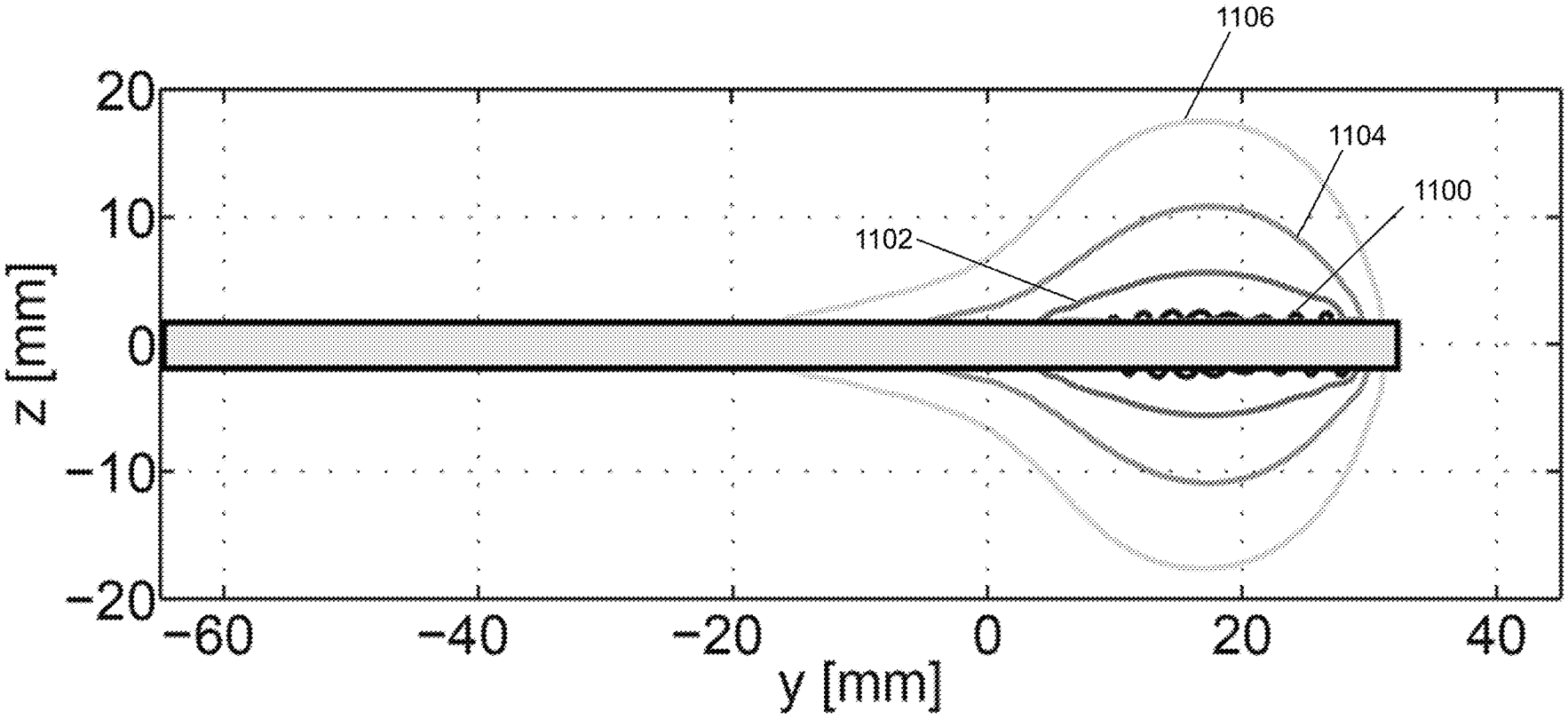
FIG. 11 shows a simulated, normalized SAR pattern of a modified MWA antenna for comparison.

Referring to FIG. 11, a simulated SAR pattern generated by the modified MWA antenna is shown. A −5 decibel (dB) curve 1100 shows a SAR level reduced by 5 dB. A −10 dB curve 1102 shows a SAR level reduced by 10 dB. A −15 dB curve 1104 shows a SAR level reduced by 15 dB. A −20 dB curve 1106 shows a SAR level reduced by 20 dB. The modified antenna generated a symmetric SAR pattern. The SAR pattern is not as localized as that show in FIG. 7 for first antenna 100*a* though.

Figure 12:
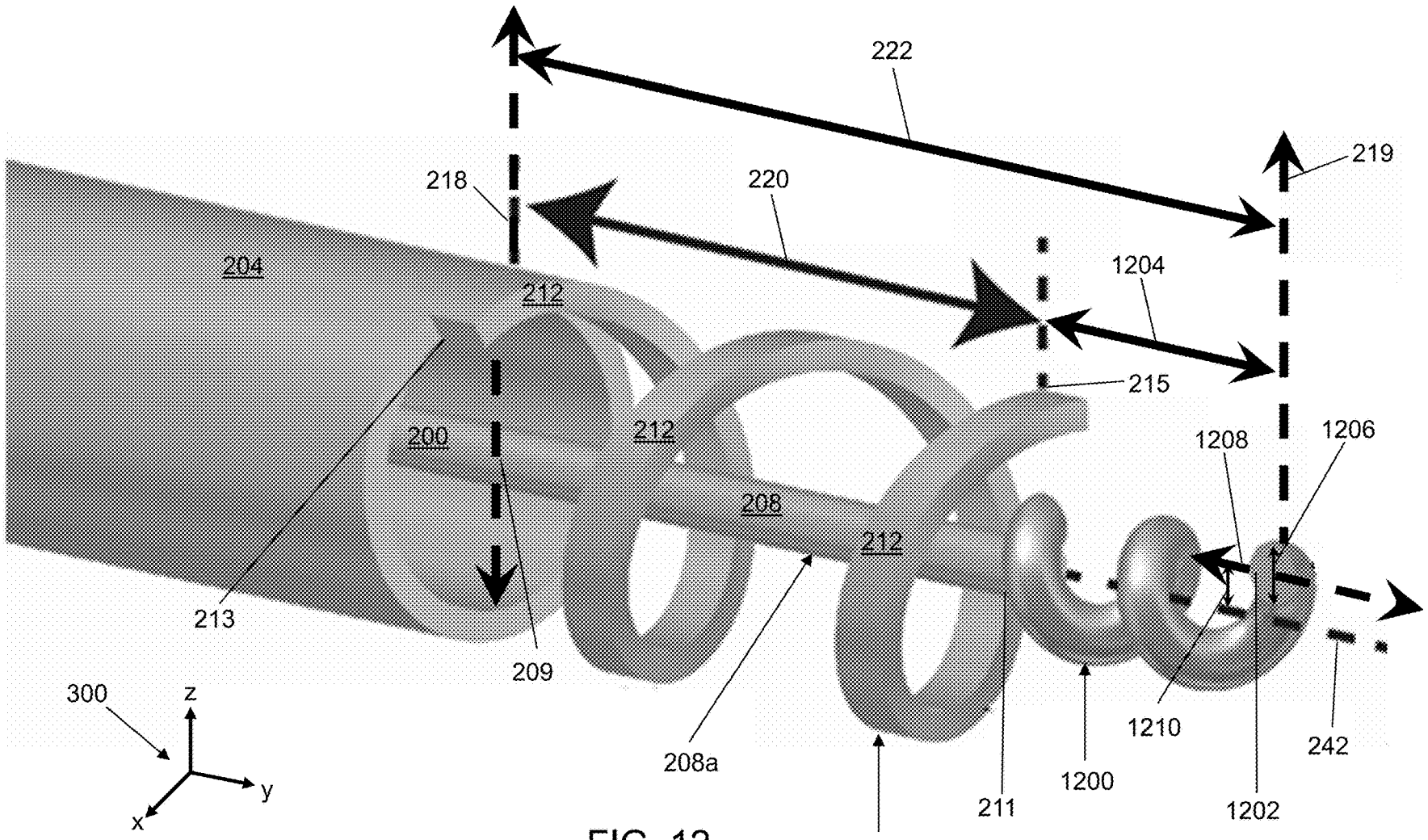
FIG. 12 depicts a perspective view of second antenna for use in the MWA antenna system of FIG. 1 in accordance with an illustrative embodiment.

Referring to FIG. 12, a perspective view of a second antenna 100*b* is shown in accordance with an illustrative embodiment. Second antenna 100*b* includes a third dipole arm 208*a* and second dipole arm 212. Third dipole arm 208*a* includes first dipole arm 208 and a first dipole arm extension 1200 that connects to and extends from first dipole arm 208. First dipole arm 208 of second antenna 100*b* has a length approximately equal to that of second dipole arm 212 though this is not required.

First dipole arm extension 1200 is formed of a conductive material that may be the same material as and/or may be an extension of first dipole arm 208. First dipole arm extension 1200 may be formed of conducting wire having one or more of a helical section, etc. A cross-section of first dipole arm extension 1200 may be circular, square, elliptical, rectangular, etc. though it is typically circular when formed as an extension of first dipole arm 208 as shown in FIG. 12. In the illustrative embodiment of FIG. 12, first dipole arm extension 1200 is formed of a single helix of circular cross-section that extends between a second end 211 of first dipole arm 208 and a second end 1202 of first dipole arm extension 1200. First dipole arm extension 1200 extends in lengthwise from second end 211 of first dipole arm 208 towards second end 1202 of first dipole arm extension 1200 parallel to center line 242 of first dipole arm 208. Like second dipole arm 212, first dipole arm extension 1200 forms a plurality of loops with center line 242 forming a center of each circular loop of the plurality of circular loops. For example, referring to FIG. 12, first dipole arm extension 1200 includes two complete circular loops. First dipole arm extension 1200 is located a second separation width 1210 from center line 242. Like separation width 404, second separation width 1210 is measured between center line 242 and a third center line 1208 of first dipole arm extension 1200.

When combined, first dipole arm 208 and first dipole arm extension 1200 have first dipole arm length 222 measured between feed vector 218 and end vector 219. First dipole arm extension 1200 has first dipole arm extension length 1204 measured between second end 211 of first dipole arm 208 and end vector 219. A first dipole arm extension width 1206 defines a cross-section width of first dipole arm extension 1200. When first dipole arm extension 1200 has a circular cross-section, first dipole arm extension width 1206 is a diameter of first dipole arm extension 1200. For illustration, first dipole arm extension width 1206 is equal to center conductor width 224 and to first dipole arm width 234 and is approximately 0.51 millimeters (mm). For further illustration, a length of first dipole arm 208 may be equal to second dipole arm length 220 between first end 209 and second end 211 of first dipole arm 208. For still further illustration, second separation distance 1210 may be 0.5 mm though first dipole arm extension 1200 may be located at other heights up to that defined by separation width 404.

A number of turns of second dipole arm 212 may be selected as 10 using $N=\sqrt{l_t^2-l_h^2}/(\pi D)$ with $l_t=3\lambda_o/4$ with $l_h$=14 mm. Again, second dipole arm length 220 $l_h$ can be chosen between $0.1\lambda_o$ and $0.2\lambda_o$, inclusive. A number of turns of first dipole arm extension 1200$N_{h2}$ may be selected as 3 using $N_{h2}=\sqrt{l_{t2}^2-l_{h2}^2}/(\pi D_{h2})$, where the overall length of first dipole arm extension 1200 is $l_{t2}$=10 mm, first dipole arm extension length 1204 is $l_{h2}$=4, and $D_{h2}$=1.0 mm, where $D_{h2}$ is twice second separation distance 1210. Based on these dimensions, first dipole arm length 222 $l_m$=18 mm based on (14+4) mm.

In the illustrative embodiment of first antenna 100*a*, first dipole arm length 222 of first dipole arm 208 was 23 mm. In the illustrative embodiment of second antenna 100*b*, first dipole arm 208 was reduced in length by 9 mm to 14 mm. To compensate, first dipole arm extension 1200 was formed as a helix with $N_{h2}$=3 turns. A helix with $D_{h2}$=1 mm and $N_{h2}$=3 turns has an overall length of $l_{t2}$=10 mm, resulting in an overall first arm length of first dipole arm 208 and of first dipole arm extension 1200 of 24 mm, which is approximately equal to 23 mm. $l_h$=14 mm was chosen for second dipole arm 212 or $l_h \leq 0.778 * l_m$ making second dipole arm length 220 $l_h$ 22.2% less than first dipole arm length 222.

Figure 13:
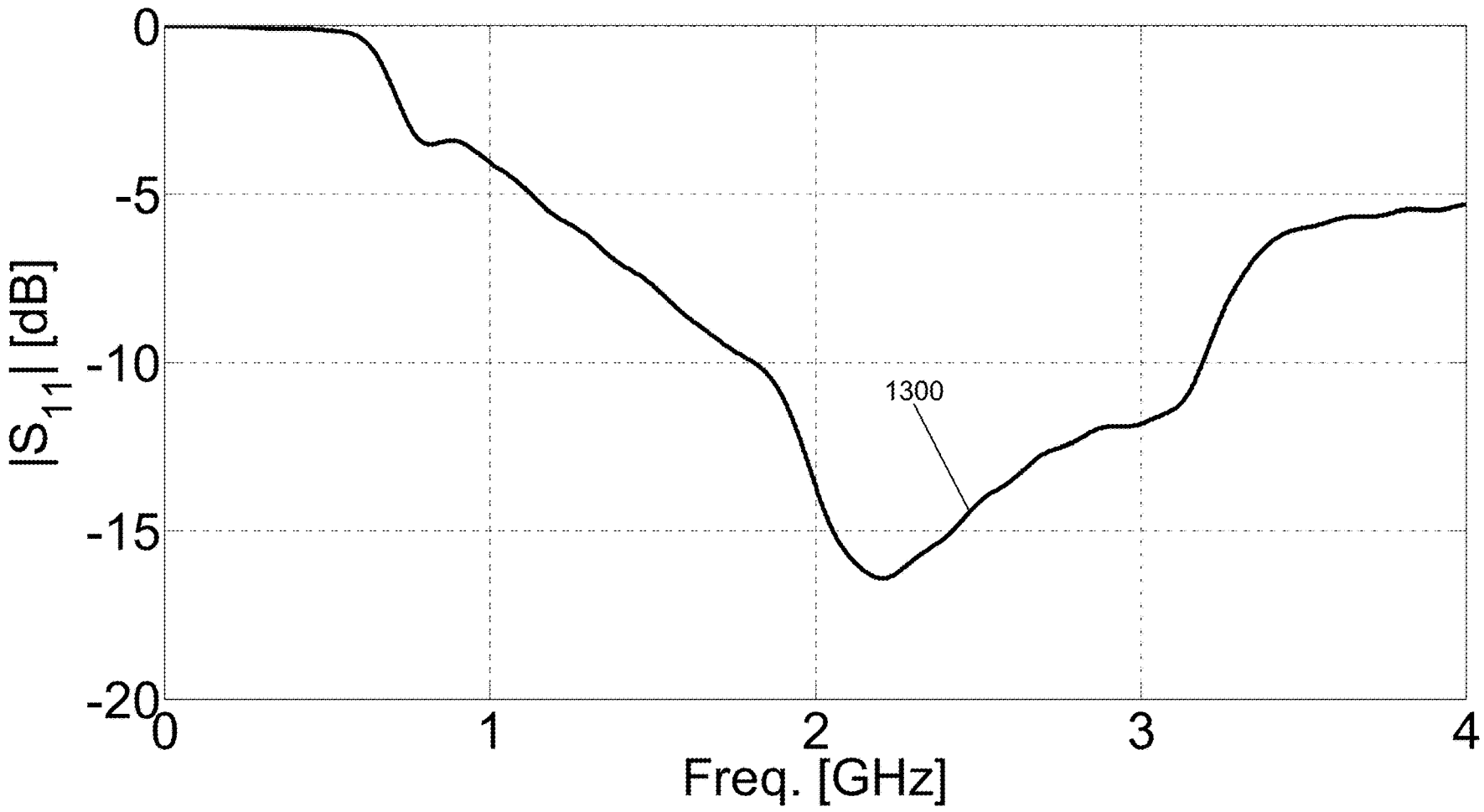
FIG. 13 shows a simulated reflection coefficient, $|S_{11}|$, of the second antenna of FIG. 12 in accordance with an illustrative embodiment.

Referring to FIG. 13, a simulated reflection coefficient, $|S_{11}|$, of second antenna 100*b* is shown by a fifth $|S_{11}|$ curve 1300. The simulated reflection coefficient, $|S_{11}|$, at 1.9 GHz was −10.3 dB.

Figure 14:
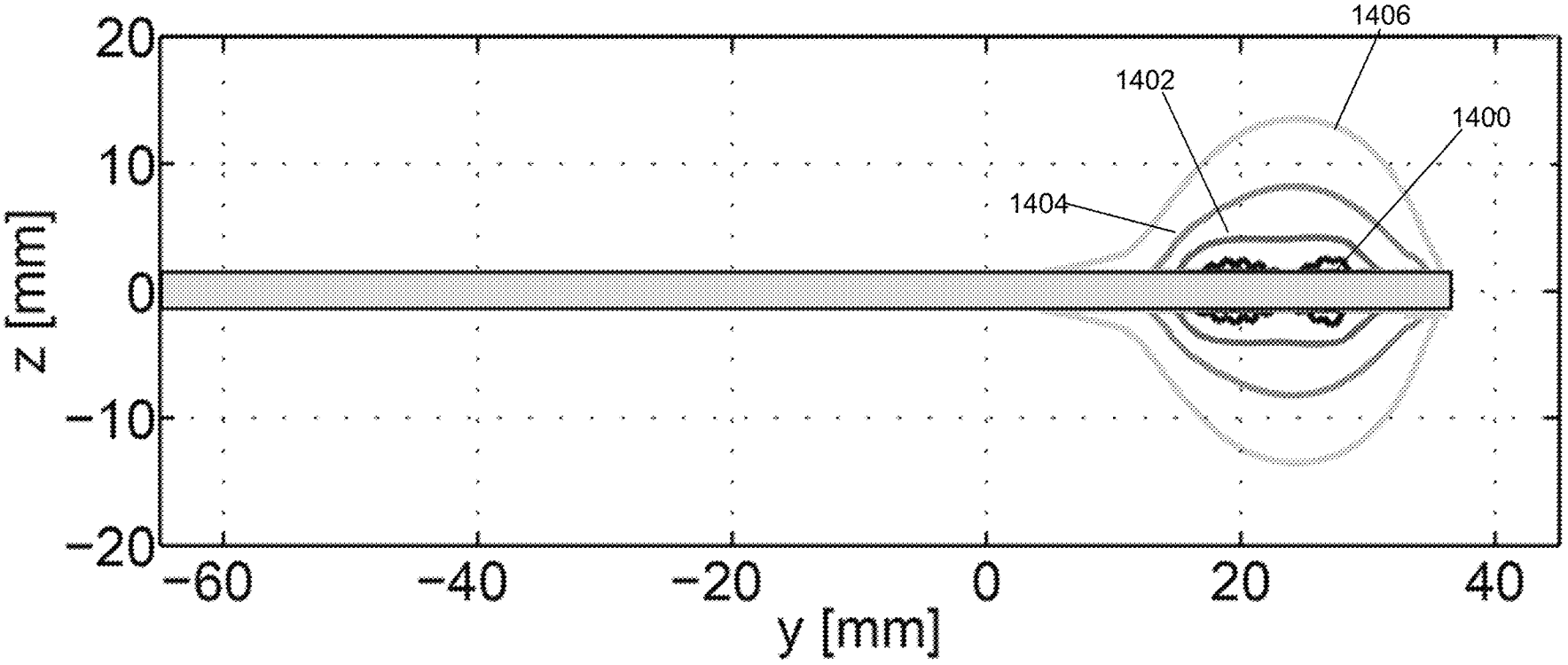
FIG. 14 shows a simulated, normalized SAR pattern of the second antenna of FIG. 12 in the y-z plane in accordance with an illustrative embodiment.

Referring to FIG. 14, a simulated SAR pattern generated by second antenna 100*b* is shown. A −5 decibel (dB) curve 1400 shows a SAR level reduced by 5 dB. A −10 dB curve 1402 shows a SAR level reduced by 10 dB. A −15 dB curve 1404 shows a SAR level reduced by 15 dB. A −20 dB curve 1406 shows a SAR level reduced by 20 dB.

Figure 15:
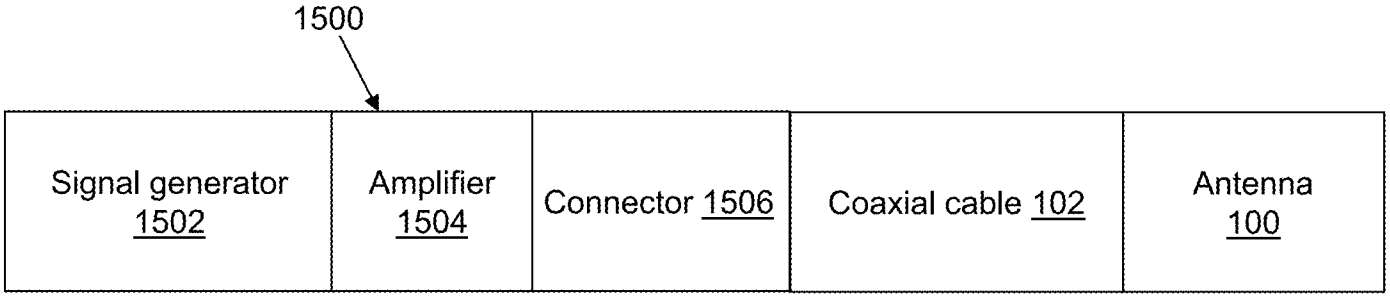
FIG. 15 depicts a block diagram of a MWA system incorporating the MWA antenna system of FIG. 1 in accordance with an illustrative embodiment.

Referring to FIG. 15, a block diagram of a MWA system 1500 is shown in accordance with an illustrative embodiment. MWA system 1500 may include a signal generator 1502, an amplifier 1504, a connector 1506, coaxial cable 102, and antenna 100 that may be first antenna 100*a* or second antenna 100*b*. Signal generator 1502 generates an analog signal at the operating frequency selected for first antenna 100*a* or second antenna 100*b*. A duty cycle of the analog signal may be controlled by signal generator 1502 based, for example, on an ablation zone size and heating rate. The analog signal may be amplified by amplifier 1504. Connector 1506 connects a second end of coaxial cable 102 opposite first antenna 100*a* or second antenna 100*b* to amplifier 1504. The loss through coaxial cable 102 may be considered when adjusting an output power level of amplifier 1504 for a desired input power level to first antenna 100*a* or second antenna 100*b*. Connector 1506 may be a coaxial connector designed to maintain the coaxial form across the connection and having a same impedance as coaxial cable 102.

First antenna 100*a* and second antenna 100*b* are balun-free dipole antennas that generate localized heating patterns in microwave ablation. The dipole antenna of first antenna 100*a* is created by extending the outer and inner conductors of coaxial cable 102. One dipole arm is a helical outer conductor (second dipole arm 212) encompassing the other arm that is the extended center conductor 200 that is the inner conductor of coaxial cable 102. In the illustrative embodiment, the overall lengths of second dipole arm 212 and first dipole arm 208 are three quarters and one quarter of a wavelength, respectively. The current direction in the conductor of second dipole arm 212 reverses direction a quarter of a wavelength away from the feed point becoming aligned with the current direction in the conductor of first dipole arm 208. This creates a low input impedance, choking the current on an outer surface of conductive shield 204 of coaxial cable 102. The fields produced by the currents flowing on the dipole arms destructively interfere closer to the feed point, while constructively interfering further from it, which helps first antenna 100*a* and second antenna 100*b* produce nearly spherical ablation zones. First antenna 100*a* and second antenna 100*b* can be used to perform minimally invasive ablation therapy within flexible and maneuverable embodiments.

First antenna 100*a* and second antenna 100*b* have several advantages compared to previous MWA antennas: 1) first antenna 100*a* and second antenna 100*b* generate localized ablation zones without using a balun, 2) the length of the radiating section of first antenna 100*a* and second antenna 100*b* can be made compact; and 3) first antenna 100*a* and second antenna 100*b* do not need an impedance matching network. As understood by a person of skill in the art, at least some of the dimensions described herein are a function of the wavelength and/or characteristics of coaxial cable 102 selected for the MWA antenna system and/or a size determined based on a type of procedure. Additionally, for simplicity of construction some of the width dimensions are illustrated as the same though this is not required.

As used in this disclosure, the term "connect" includes join, unite, mount, couple, associate, insert, hang, hold, affix, attach, fasten, bind, paste, secure, bolt, screw, rivet, pin, nail, clasp, clamp, cement, fuse, solder, weld, glue, form over, slide together, layer, and other like terms. The phrases "connected on" and "connected to" include any interior or exterior portion of the element referenced. Elements referenced as connected to each other herein may further be integrally formed together. As a result, elements described herein as being connected to each other need not be discrete structural elements. The elements may be connected permanently, removably, or releasably.

As used in this disclosure, the term "mount" includes join, unite, connect, couple, associate, insert, hang, hold, affix, attach, fasten, bind, paste, secure, bolt, screw, rivet, pin, nail, clasp, clamp, cement, fuse, solder, weld, glue, form over, slide together, layer, and other like terms. The phrases "mounted on" and "mounted to" include any interior or exterior portion of the element referenced. These phrases also encompass direct connection (in which the referenced elements are in direct contact) and indirect connection (in which the referenced elements are not in direct contact, but are mounted together via intermediate elements). Elements referenced as mounted to each other herein may further be integrally formed together. As a result, elements described herein as being mounted to each other need not be discrete structural elements. The elements may be mounted permanently, removably, or releasably.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, the use of "and" or "or" in the detailed description is intended to include "and/or" unless specifically indicated otherwise.

The foregoing description of illustrative embodiments of the disclosed subject matter has been presented for purposes of illustration and of description. It is not intended to be exhaustive or to limit the disclosed subject matter to the precise form disclosed, and modifications and variations are possible in light of the above teachings or may be acquired from practice of the disclosed subject matter. The embodiments were chosen and described in order to explain the principles of the disclosed subject matter and as practical applications of the disclosed subject matter to enable one skilled in the art to utilize the disclosed subject matter in various embodiments and with various modifications as suited to the particular use contemplated. It is intended that the scope of the disclosed subject matter be defined by the claims appended hereto and their equivalents.

What is claimed is:

1. An antenna comprising:

a first dipole arm connected to a first conductor and formed of a first conducting material, wherein the first dipole arm extends in an axial direction from the first conductor; and a second dipole arm connected to a second conductor that is distinct from the first conductor and formed of a second conducting material, wherein the second dipole arm extends in the axial direction from the second conductor and is wound around the first dipole arm to form a number of loops, wherein the second dipole arm does not contact the first dipole arm, wherein an axial length of the second dipole arm in the axial direction is less than 90% of an axial length of the first dipole arm in the axial direction, wherein the axial length of the first dipole arm is approximately 0.25λ, where λ is a wavelength at an operating frequency of a signal carried by the first conductor and the second conductor in a medium in which the antenna is selected to operate, wherein the axial length of the second dipole arm is between 0.1Λ and 0.2λ, inclusive.

2. The antenna of claim 1, wherein the axial length of the second dipole arm in the axial direction is less than 80% of the axial length of the first dipole arm in the axial direction.

3. The antenna of claim 1, wherein a total length of the first dipole arm is an integer multiple of a quarter wavelength at the operating frequency of the signal carried by the first conductor and the second conductor in the medium in which the antenna is selected to operate.

4. The antenna of claim 1, wherein a total length of the first dipole arm is approximately 0.25λ.

5. The antenna of claim 1, wherein a total length of the second dipole arm is approximately 0.25λ+m*0.52λ, where m is an integer value.

6. The antenna of claim 1, wherein a total length of the second dipole arm is approximately 0.75λ.

7. The antenna of claim 1, wherein the number of loops is $N=\sqrt{l_t^2-l_h^2}/(\pi D)$, where N is the number of loops, $l_t$ is a total length of the second dipole arm, $l_h$ is the axial length of the second dipole arm, and D is twice a separation distance between a center of the first dipole arm in a radial plane perpendicular to the axial direction and a center of the second dipole arm in the radial plane perpendicular to the axial direction measured as a mean value for a complete loop of the second dipole arm in the axial direction.

8. The antenna of claim 1, wherein the second conductor is an outer conductor of a coaxial cable.

9. The antenna of claim 8, wherein the first conductor is an inner center conductor of the coaxial cable.

10. The antenna of claim 9, wherein the first conductor is an extension of the inner center conductor of the coaxial cable.

11. The antenna of claim 1, further comprising a dipole arm extension connected to an end of the first dipole arm that is opposite the connection between the first conductor and the first dipole arm, wherein the dipole arm extension is formed of a third conducting material, wherein the dipole arm extension extends in the axial direction from the first dipole arm and is wound around a center axis of the axial direction through a center of the first dipole arm to form a second number of loops, wherein the second dipole arm does not contact the dipole arm extension, wherein the axial length of the first dipole arm in the axial direction includes an axial length of the dipole arm extension.

12. The antenna of claim 11, wherein the first conducting material and the third conducting material are the same material.

13. The antenna of claim 11, wherein the second number of loops is $N=\sqrt{l_t^2-l_h^2}/(\pi D)$, where N is the second number of loops, $l_t$ is a total length of the dipole arm extension, $l_h$ is the axial length of the dipole arm extension, and D is twice a separation distance between a center of the dipole arm extension in a radial plane perpendicular to the axial direction measured as a mean value for a complete loop of the second dipole arm in the axial direction and a center of the first dipole arm in the radial plane perpendicular to the axial direction.

14. An antenna system comprising:

a coaxial cable comprising a center conductor extending a length of the coaxial cable;

a dielectric material surrounding the center conductor along the length of the coaxial cable; and a conductive shield surrounding the dielectric material along the length of the coaxial cable; and an antenna comprising a first dipole arm connected to the center conductor and formed of a first conducting material, wherein the first dipole arm extends in an axial direction from the center conductor; and a second dipole arm connected to the conductive shield that is distinct from the center conductor and formed of a second conducting material, wherein the second dipole arm extends in the axial direction from the conductive shield and is wound around the first dipole arm to form a number of loops, wherein the second dipole arm does not contact the first dipole arm, wherein an axial length of the second dipole arm in the axial direction is less than 90% of an axial length of the first dipole arm in the axial direction, wherein the axial length of the first dipole arm is approximately 0.25λ, where λ is a wavelength at an operating frequency of a signal carried by the first conductor and the second conductor in a medium in which the antenna is selected to operate, wherein the axial length of the second dipole arm is between 0.1λ and 0.2λ, inclusive.

15. The antenna system of claim 14, wherein a total length of the second dipole arm is approximately 0.25λ+m*0.5λ, where m is an integer value.

16. A microwave ablation system comprising:

an antenna system comprising a coaxial cable comprising a center conductor extending a length of the coaxial cable;

a dielectric material surrounding the center conductor along the length of the coaxial cable; and a conductive shield surrounding the dielectric material along the length of the coaxial cable;

an antenna comprising a first dipole arm connected to the center conductor and formed of a first conducting material, wherein the first dipole arm extends in an axial direction from the center conductor; and a second dipole arm connected to the conductive shield that is distinct from the center conductor and formed of a second conducting material, wherein the second dipole arm extends in the axial direction from the conductive shield and is wound around the first dipole arm to form a number of loops, wherein the second dipole arm does not contact the first dipole arm, wherein an axial length of the second dipole arm in the axial direction is less than 90% of an axial length of the first dipole arm in the axial direction;

a signal generator configured to generate a signal at a selected operating frequency; and a connector configured to connect a second end of the coaxial cable opposite the antenna to the signal generator to receive the generated signal.

17. The microwave ablation system of claim 16, wherein the axial length of the first dipole arm is approximately 0.25λ, where λ is a wavelength at an operating frequency of a signal carried by the first conductor and the second conductor in a medium in which the antenna is selected to operate, wherein the axial length of the second dipole arm is between 0.1λ and 0.2λ, inclusive.

18. The antenna system of claim 14, wherein the number of loops is $N=\sqrt{l_t^2-l_h^2}/(\pi D)$, where N is the number of loops, $l_t$ is a total length of the second dipole arm, $l_h$ is the axial length of the second dipole arm, and D is twice a separation distance between a center of the first dipole arm in a radial plane perpendicular to the axial direction and a center of the second dipole arm in the radial plane perpendicular to the axial direction measured as a mean value for a complete loop of the second dipole arm in the axial direction.

19. The antenna system of claim 14, further comprising a dipole arm extension connected to an end of the first dipole arm that is opposite the connection between the first conductor and the first dipole arm, wherein the dipole arm extension is formed of a third conducting material, wherein the dipole arm extension extends in the axial direction from the first dipole arm and is wound around a center axis of the axial direction through a center of the first dipole arm to form a second number of loops, wherein the second dipole arm does not contact the dipole arm extension, wherein the axial length of the first dipole arm in the axial direction includes an axial length of the dipole arm extension.

20. The antenna system of claim 19, wherein the second number of loops is $N=\sqrt{l_t^2-l_h^2}/(\pi D)$, where N is the second number of loops, $l_t$ is a total length of the dipole arm extension, $l_h$ is the axial length of the dipole arm extension, and D is twice a separation distance between a center of the dipole arm extension in a radial plane perpendicular to the axial direction measured as a mean value for a complete loop of the second dipole arm in the axial direction and a center of the first dipole arm in the radial plane perpendicular to the axial direction.

* * * * *